US005207176A

United States Patent [19]

Morhard et al.

[11] Patent Number: 5,207,176

[45] Date of Patent: May 4, 1993

[54] HAZARDOUS WASTE INCINERATOR AND CONTROL SYSTEM

[75] Inventors: Robert C. Morhard, Wylie, Tex.; Peter J. Astrauskas; Michael E. Weber, both of Joplin, Mo.; Irving H. Tyler, Greensboro, N.C.; Donald R. Beltz, Allentown, Pa.; Mark M. Zaugg, Bountiful, Utah; Stanley E. Hill, Corona; Charles J. Trom, Costa Mesa, both of Calif.; Johnny R. Isbell, El Dorado, Ark.; Thomas E. Berty, Tustin, Calif.

[73] Assignee: ICI Explosives USA Inc, Wilmington, Del.

[21] Appl. No.: 616,192

[22] Filed: Nov. 20, 1990

[51] Int. Cl.[5] ..... A47J 36/00; A47J 36/24

[52] U.S. Cl. ..... 110/246; 110/101 CC; 110/215; 110/226; 110/259; 110/345; 110/346; 414/149; 432/117; 432/118

[58] Field of Search ..... 110/259, 226, 246, 346, 110/345, 215, 255, 258, 101 R, 101 CC; 414/149; 432/117, 118

[56] References Cited

U.S. PATENT DOCUMENTS 3,848,548 11/1974 Bolejack, Jr. et al. .
3,940,239 2/1976 Rossi et al. .
3,987,916 10/1976 Cates, Jr. et al. .
4,308,809 1/1982 Woods ..... 110/193 X
4,315,712 2/1982 Seglias ..... 110/246 X
4,320,709 3/1982 Hladun .
4,399,756 8/1983 Lientz ..... 110/346
4,571,175 2/1986 Bogle et al. .
4,575,336 3/1986 Mudd et al. .
4,629,500 12/1986 Janz et al. .
4,648,333 3/1987 Mudd et al. .
4,781,580 11/1988 Janz et al. .
4,831,940 5/1989 Franza ..... 110/259
4,922,841 5/1990 Kent ..... 110/259 X
4,958,578 9/1990 Houser ..... 110/246
4,969,407 11/1990 Benoit et al. ..... 110/346
5,006,322 4/1991 Schuetzenduebel et al. ... 110/215 X
5,018,457 5/1991 Brady et al. ..... 110/215 X

*Primary Examiner*—Edward G. Favors
*Attorney, Agent, or Firm*—Bruce W. Slayden, II

[57] ABSTRACT

A hazardous waste incinerator (100) includes a rotary kiln (120) with a helical flight (250) within. The kiln (120) is fed hazardous waste by either a continuous feed system (164) or a positive feed system (162). The kiln (120) is comprised of six retort sections (202, 202, 204, 206, 208, 210). The combusted waste is separated into ash and recoverable metals. The air flow is counter to the flow of waste through the kiln (120), with exhaust gases vented from the kiln entrance. Fugitive emissions are also contained by shrouds (164, 166) and containment building (160). These exhaust gases pass through the secondary combustor (130) to ensure destruction of any principle organic hazardous constituents. The exhaust gases are then treated in a spray dryer (140) to cool it and neutralize any acidic components. A baghouse (150) then removes any remaining particulate matter before the exhaust exits the stack (156). The control system includes a program-controlled processor unit (400) connected by an optical/electrical interface (402) to an optical data highway loop (404). All parametric sensors of each subsystem is connected to the data loop (404).

83 Claims, 16 Drawing Sheets

HAZARDOUS WASTE INCINERATOR AND CONTROL SYSTEM

TECHNICAL FIELD OF THE INVENTION

The present invention relates to an incinerator for use in destroying hazardous waste such as pyrotechnics, explosives, propellants, configured munitions, and reactive waste. Said incinerator incorporates a control system which regulates the rate and quantity of pollutants released to the environment.

BACKGROUND OF THE INVENTION

Incineration provides a safe and effective method of destroying hazardous wastes. Such wastes generally include pyrotechnics, explosives, and propellants, collectively known as "PEP". Pyrotechnics are powders that burn at less than the speed of sound. Explosives are typically defined as any chemical compound, mixture or device, the primary purpose of which is to function by explosion, i.e., with substantially instantaneous release of gas and heat. The waste may also include configured munitions and reactive waste. Configured munitions are devices with PEP contained within. For example, configured munitions include, but are not limited to, ammunition, mortar shells, fuzes, detonators, grenades, and rocket motors, and so forth. Reactive waste is typically a solid waste exhibiting the characteristic of reactivity as defined by 40 C.F.R. § 261.23. Examples of reactive waste include, but are not limited to, scrap propellants, scrap explosives, scrap pyrotechnics, sludge, and reactive soil and debris.

Incineration involves the exposure of the waste material to high temperatures for extended periods of time. The purpose of this exposure is to oxidize the material rather than detonate it. Due to the composition of hazardous waste, toxic gases are usually emitted during the oxidation or combustion of the waste material. Due to their toxic nature, such emissions are tightly regulated. Therefore, the emissions must be treated to meet regulatory requirements.

Incineration of the hazardous waste described above may be accomplished by several methods. Because temperature at the point of oxidation may reach approximately 3000° F., and pressures from detonation may reach one to three million pounds per square inch at the point of detonation, the most common incineration method involves the use of a specially designed rotary kiln. Most common rotary kiln incinerators for hazardous waste are lined with refractory material and mounted on an incline to move materials through the kiln. However, such kilns are not satisfactory for incinerating items that might detonate when burned because of the damage it does to the refractory material. The rotary kiln developed by the U.S. Army for destruction of bulk explosives and propellants, and configured munitions is mounted horizontally and is an unlined, thick walled, cast steel kiln with internal helical flights as part of the casting that push the materials through the kiln as it rotates.

The material to be burned is fed into one end of the kiln and is pushed toward the exit end of the kiln by the rotation of the kiln. A fuel oil fired burner at the exit end of the kiln provides the heated air and the flame to burn the material in the kiln. The heated air and flame is pulled toward the entrance end of the kiln by an induced draft fan at the end of an associated air pollution control system (APCS). Temperatures within the kiln are supplemented by the oxidation of the explosive wastes.

The Army's rotary kiln, designated as the Ammunition Peculiar Equipment (APE) 1236 Deactivation Furnace (DF), consists of four five-foot long retort sections bolted together, with a nominal diameter of 3 feet, and wall thicknesses between 2¼ and 3¼ inches. The rotary kiln is rotated on trunions driven by a variable speed drive system. As the kiln rotates, internal spiral flights propel the feed material through the retort. The spiral flights also prevent sympathetic explosive propagation between the areas of the kiln divided by the spiral flights. Typically, the flights are spaced 30 inches apart and average 10 inches in height.

The material is introduced into the APE-1236 kiln by either a continuous feed system or a positive feed system. The continuous feed system utilizes a two-section straight conveyor system leading to the kiln entrance and feeds the kiln a continuous stream of waste material. Due to the straight configuration of these conveyors, a premature explosion by the waste upon entering the kiln could cause the primary conveyor to buck back toward the kiln operators. The positive feed system utilizes steel boxes to carry batches of bulk waste material. The steel box is placed on a conveyor which carries it to a transfer station, where the box is moved laterally in front of the kiln ingress. A ram then pushes the box into the kiln. The material inside the box is oxidized and the box is recovered at the kiln exit for reuse after cooling.

The feed housing on the APE-1236 is designed such that change between the use of the conveyor feed system and the positive feed system requires the removal of a lower portion of the gravity feed chute when the positive feed system is used, and replacing that portion when using the conveyor feed system. To make this change requires shutting down the furnace, and allowing it to cool before personnel can physically make the change. Also, the APE-1236 feed chute is located in a larger housing that periodically needs to be emptied of the munitions items that are kicked out of the kiln by the detonation of other items. There is a large door in the front of the feed housing that is opened to gain access to clean the housing and to also gain access to the lower portion of the feed chute for change out. The ram and transfer conveyor of the positive feed system must be moved out of the way to open the feed housing door.

The air pollution control system for the APE-1236 kiln consists of a primary exhaust vent and shroud, said shroud extending over the entire length of the kiln and over the feed chute. The primary exhaust vent draws exhaust gas from the inside of the kiln. The shroud attempts to contain fugitive emissions escaping from between the retort sections or from the ingress or egress of the kiln. Air is pulled into the shroud through vents by the combustion air blowers for the primary burner and secondary combustor. The primary exhaust or flue gas from the kiln is taken to a secondary combustor. The secondary combustor can raise the temperature of this exhaust or flue gas to approximately 1880° F. for 1 second, attempting to oxidize any unburned waste material in the gas, such as unburned reactive materials, or principle organic hazardous constituents (POHC). The APE-1236 achieves a 99.99% destruction removal efficiency (DRE). The exhaust then passes through a high temperature gas cooler, a low temperature gas cooler, a cyclone, a baghouse in which most particulate matter is eliminated, an induction draft fan, and then exits to the atmosphere through an exhaust stack.

The APE-1236, however, requires operational limitations and other limits on what materials can be incinerated in it to comply with environmental standards. Specifically, the APE-1236 has no provisions to control the acidity of emissions. Thus, feed rates involving heavy metals such as lead, cadmium, or those producing acid gases must be based on the allowable emissions from these metals, or acids, rather than on the greater capacity of the kiln to handle the reactivity of the material being fed. The APE-1236 also fails to adequately control the emission of particulates.

Therefore, a need exists for an incinerator that safely and effectively destroys the entire family of PEP, configured munitions and devices, and hazardous reactive wastes at efficient rates based on the limits of the incinerator, not the emission regulations. The incinerator must be capable of exposing the waste materials to high temperatures for an extended period of time. The incinerator system must also be capable of withstanding the accidental detonation of the wastes. The system must also be designed to control the emission of toxic gases which are the by-products of the burning waste. This control system must be able to detect "upset"situations at any location of the incinerator system and respond accordingly. The control system must also be capable of being updated to meet ever changing regulations. Most importantly, the incinerator must be designed to protect the safety of its operators from both explosions and toxic emissions.

SUMMARY OF THE INVENTION

This invention relates to a novel incinerator for use in destroying hazardous wastes. The incinerator is comprised of a rotary kiln within a containment building, primary, secondary and tertiary control of emissions, a positive feed system, a continuous feed system, a kiln discharge handling system, a secondary combustor and air pollution controls. The incinerator also incorporates a distributed control system with environmental monitoring. The incinerator is designed to safely and effectively destroy wastes including pyrotechnics, explosives, propellants, configured munitions and devices and reactive waste. Such wastes may include detonators, blasting caps, igniters, boosters, ammunition, fuzes, primers, explosive leads, gas generators, explosive actuated devices, scrap explosives, scrap pyrotechnics, scrap propellants, reactive soil and debris or any other material displaying the hazardous waste characteristics of reactivity as defined by 40 C.F.R. § 261.23. The waste may also include water treatment sludges from the manufacturing and processing of explosives.

In a preferred embodiment, the kiln is generally cylindrical with a helical flight within. The kiln also contains a feed opening and a discharge opening, respectively located at the ingress and egress of the kiln. The choke of this helical flight varies along the length of the kiln. The kiln uses six retort sections in order to increase the solids residence time. The increased residence time provides greater destruction effectiveness for the more difficult to incinerate feeds. Each retort section is bolted to its adjacent section with a gasket therebetween. A charge and a discharge assembly are respectively located at the ingress and egress of the kiln. The kiln is revolved on trunions, said trunions driven by a variable speed drive system. A stationary feed assembly covers the feed ingress and a discharge assembly covers the feed egress or discharge opening.

Control of fugitive emissions to satisfy environmental regulations is addressed by primary, secondary and tertiary emission controls. Primary emission control is accomplished by operating the kiln under negative pressure. An induced draft fan draws large volumes of air through the kiln to aid the efficient and effective burning of waste as well as to draw off toxic emissions. The design of the kiln must ensure that air leakage into the kiln through the feed and discharge openings and through the rotating kiln seals is kept under control in order to achieve the desired operating condition of the kiln. The present invention will always operate under extremely high excess air conditions. This ensures that sufficient oxygen is always available for the combustion of the waste feed material, as well as assist in establishing a uniform temperature profile along the kiln. For example, when the kiln is operating with the continuous feed system, up to 3850 actual cubic feet/minute of air is drawn through the discharge opening and feed opening.

Secondary containment of fugitive emissions is accomplished by a carbon steel shroud over each end of the kiln. This shroud collects fugitive emissions from the gap between the end assemblies and the revolving retort. The stationary shroud contains these emissions by forming a near air tight seal with the revolving kiln and a plenum to capture the fugitive emissions. The fugitive emissions are returned to the kiln by drawing combustion air through each shroud with the primary combustion air blower. Typically, approximately 1100 cubic feet/minute of air is pulled through both shrouds.

A kiln containment building provides tertiary control of fugitive emissions. The building houses the rotary kiln and portions of the continuous feed and positive feed system. By its unique design, the building will provide tertiary containment of fugitive emissions as well as blast and fragmentation protection for operators. Typically, 12-inch thick and ten to fifteen foot high concrete blast walls are located near each end of the kiln, and ½ inch thick and 8 foot high steel plates at the sides will provide protection for plant operators from accidental explosions inside the kiln containment building. A conventional fabricated metal building over the safety walls will provide containment for the occasional flue gas "puffs" or explosively generated overpressure events that may be released from the kiln and kiln shrouds. The building is air tight and operates under negative pressure. Flue gas escaping from the kiln shrouds and through the kiln feed and discharge openings will be removed from the building by a secondary air combustion blower. Blowout panels in the roof of the building will protect the structure in case an accidental explosion results in pressures in the building over a predetermined amount.

The positive feed system consists of a specially designed mechanism for injecting containers of explosives into the kiln. For materials such as bulk explosives, pyrotechnics and propellants, and certain sensitive explosive components the positive feed system reduces the chance of these very heat sensitive materials beginning to burn before they are entirely within the confines of the kiln. The system incorporates the criteria of guaranteeing there is no direct line of sight from the point the containers are injected into the retort to the point behind a concrete barricade where the containers are manually placed into the mechanism. Besides reducing the chance of explosive propagation to the loading point, the mechanisms also positively controls the feed rate to insure that only one container may be placed in the kiln at any one retort spiral flight section thereby assuring explosive safety and compliance with environmental regulations.

The positive feed system consists of elements including a weighing conveyor, a pacing conveyor, an input conveyor, a transfer conveyor, a feed ram, and a safety enclosure. Waste is placed onto the weighing conveyor in a consumable box. The weighing conveyor incorporates a belt scale for monitoring the weight of each box. The belt scale will prevent the continued feed of the consumable box containing waste, should its weight exceed a preset value. The preset value is dependent upon the type of waste and the levels of said waste allowed by regulation. Acceptable boxes are transferred to the pacing conveyor which incorporates two box holding devices. Boxes are individually released to the input conveyor which takes the consumable box containing the waste through the blast wall and to the transfer conveyor. The transfer conveyor transports the consumable box containing waste to its injection position in front of the positive feed input orifice of the feed assembly. A feed fence aligns the box with the opening. Upon receipt of a signal that the retort is in the correct position, the ram pushes the consumable box with waste into the rotary kiln opening. Under emergency shutdown conditions, the feed fence will raise and shunt the ram path and the box will be conveyed to the safety enclosure where it is cooled. This action will prevent charging the kiln with waste during upset conditions.

The continuous feed system consists of a pan conveyor system. It is used to feed assembled items, and prepackaged bulk waste. The system incorporates a loading conveyor with an integrated belt scale, a kiln feed conveyor, and a kiln charge conveyor. The feed conveyor transports and lifts the waste feed through the blast wall from the loading conveyor at grade to the charge conveyor. The charge conveyor transports the feed into an elevated feed chute. The operation of the feed conveyor is controlled by the belt scale which monitors the weight and hence feed rate of the waste. The belt scale will stop the feed conveyor if the feed rate is in excess of a preset value. The preset value is based upon the type of feed and the amount of toxic emission it will produce.

After waste is fed into the kiln, via either the continuous feed or positive feed systems, the waste is burned. The waste is transported through the rotating kiln until it encounters the kiln discharge plate. The waste, at this point, consists of ash, metals, and unmelted metal scrap. The waste is deposited onto a conveyor which takes it beyond the blast wall and deposits it onto a shaker grate which separates the ash from the recoverable metal scrap.

During combustion of the hazardous waste material, exhaust gases which may be toxic are emitted. These gases are entrained with combustion air constantly pulled through the kiln. This exhaust and combustion air, also known as flue gas, are pulled through a number of devices along a combustion air path. Combustion air flow through the kiln is counter to the waste flow, and these gases are primarily vented through a duct in the feed assembly near the kiln entrance by an induction draft fan of the air pollution control system. These toxic fumes are passed through a secondary combustor and then through air pollution control devices. The secondary combustor can elevate the temperature of the exhaust gas to approximately 2200° F. and provides a residence time of approximately 4 seconds. The combustor enhances the complete destruction of the principle organic hazardous constituents (POHC) of the exhaust gas. The exhaust gases then pass through a spray dryer where they are quenched with a dilute soda ash/water solution. Concurrent with vaporization of the water, the soda ash reacts with sulfur oxides and/or hydrochloric acid, if present, to form sodium salts. These reaction products, together with the unreacted soda ash, leave the spray dryer as solid particulate matter. The exhaust gas next passes through a baghouse wherein particulate matter entrained in the exhaust stream are collected by felt bags. The exhaust gases are then drawn to the stack by induction draft fans. The stack ensures that emissions are adequately dispersed into the atmosphere.

BRIEF DESCRIPTION OF THE DRAWINGS

For a more complete understanding of the present invention, and for further advantages thereof, reference is now made to the following Detailed Description taken in conjunction with the accompanying drawings, in which.

DETAILED DESCRIPTION

The present invention is a hazardous waste incinerator 100 with a distributed control system that overcomes many of the disadvantage found in the prior art. The present invention was designed to incinerate approximately fifteen million pounds per year of obsolete and/or off specification ammunition and bulk explosive. This rate was based on approximately 7200 hours of processing each year at approximately 2000 lbs/hour. Actual feed rates will depend on the compositions of the materials to be processed. Certain waste feed may contain or produce more pollutants than others. Therefore, the distributed control system closely monitors the stack emissions as well as other conditions and controls the feed rate accordingly.

Figure 1:
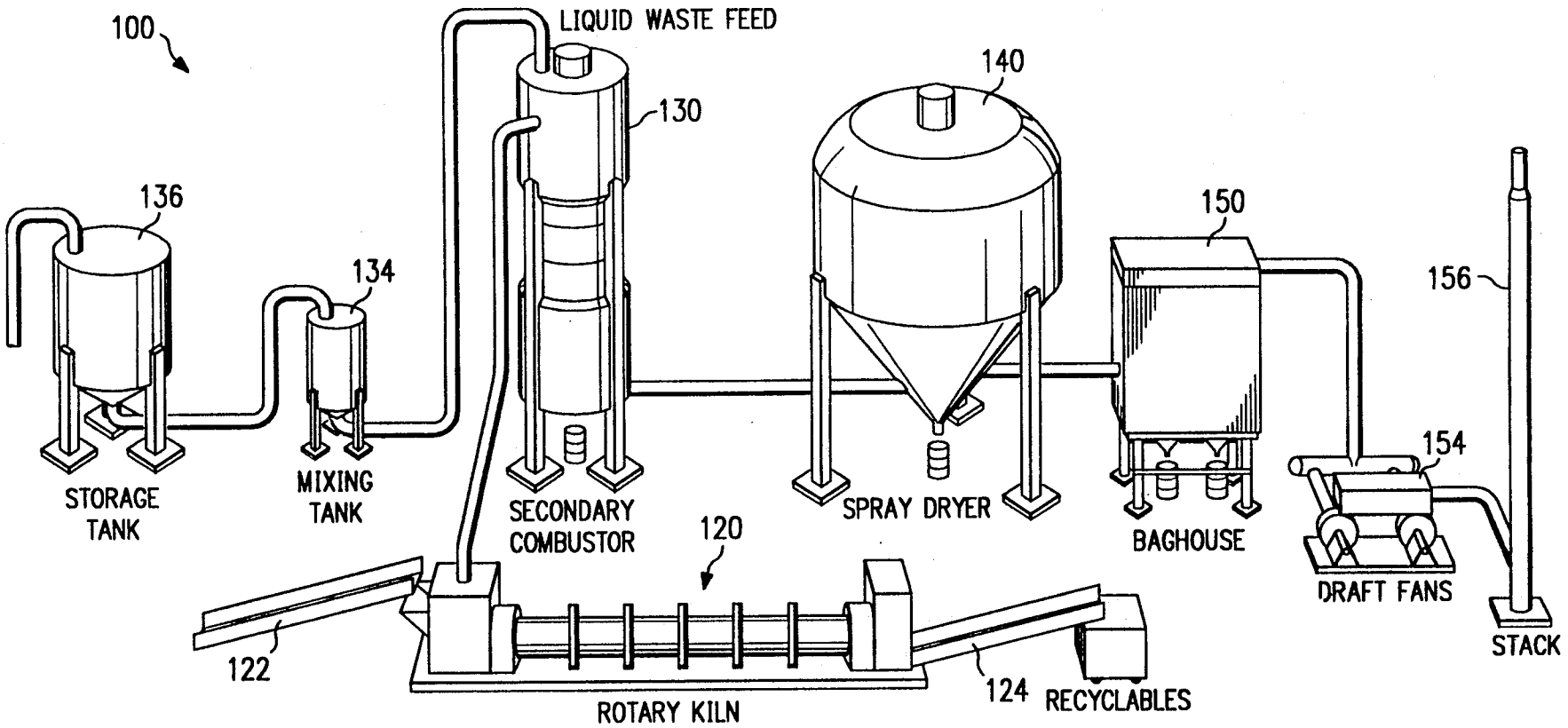
FIG. 1 is an illustration of a hazardous waste incinerator embodying the present invention.

Referring to FIG. 1, an incinerator 100 embodying the present invention is disclosed. Incinerator 100 comprises rotary kiln 120 located within a containment building (not shown), a feed system 122, a discharge handling system 124, a secondary combustor 130, and an air pollution control system comprised of a spray dryer 140, a baghouse 150, two induction draft fans 154, and a stack 156. Waste is fed to the kiln 120 by feed system 122. Combustion air is pulled through the kiln by the draft fans 154 counter to the flow of waste through the kiln. Thus, a temperature gradient is established whereby the waste feed end is cooler than the waste discharge end. Exhaust gases including toxic emissions exit the kiln and are directed into the secondary combustor 130. The secondary combustor 130 helps ensure up to a 99.9999% destruction rate efficiency of potential organic hazardous constituents (POHCs) in the exhaust from the kiln. In one embodiment, non-explosive liquid waste can be destroyed directly in the secondary combustor 130. The liquid waste is typically stored in storage tank 136. It may then be diluted in a mixing tank 134 with water before being injected directly into the secondary combustor 130.

The exhaust from the secondary combustor next enters the spray dryer 140 which introduces a premixed soda ash solution for the neutralization of acid gases. This combination produces sodium salts which fall out of the exhaust stream. Next, the baghouse is designed to remove entrained particulate matter to below an emission rate of 0.03 grains/dry standard cubic feet (dscf). The entire combustion air path is maintained under a negative pressure by two induced draft fans 154 located near the discharge end of the APCS which in turn exhaust process gases to the atmosphere via stack 156. The stack is approximately 215 feet tall.

Figure 2:
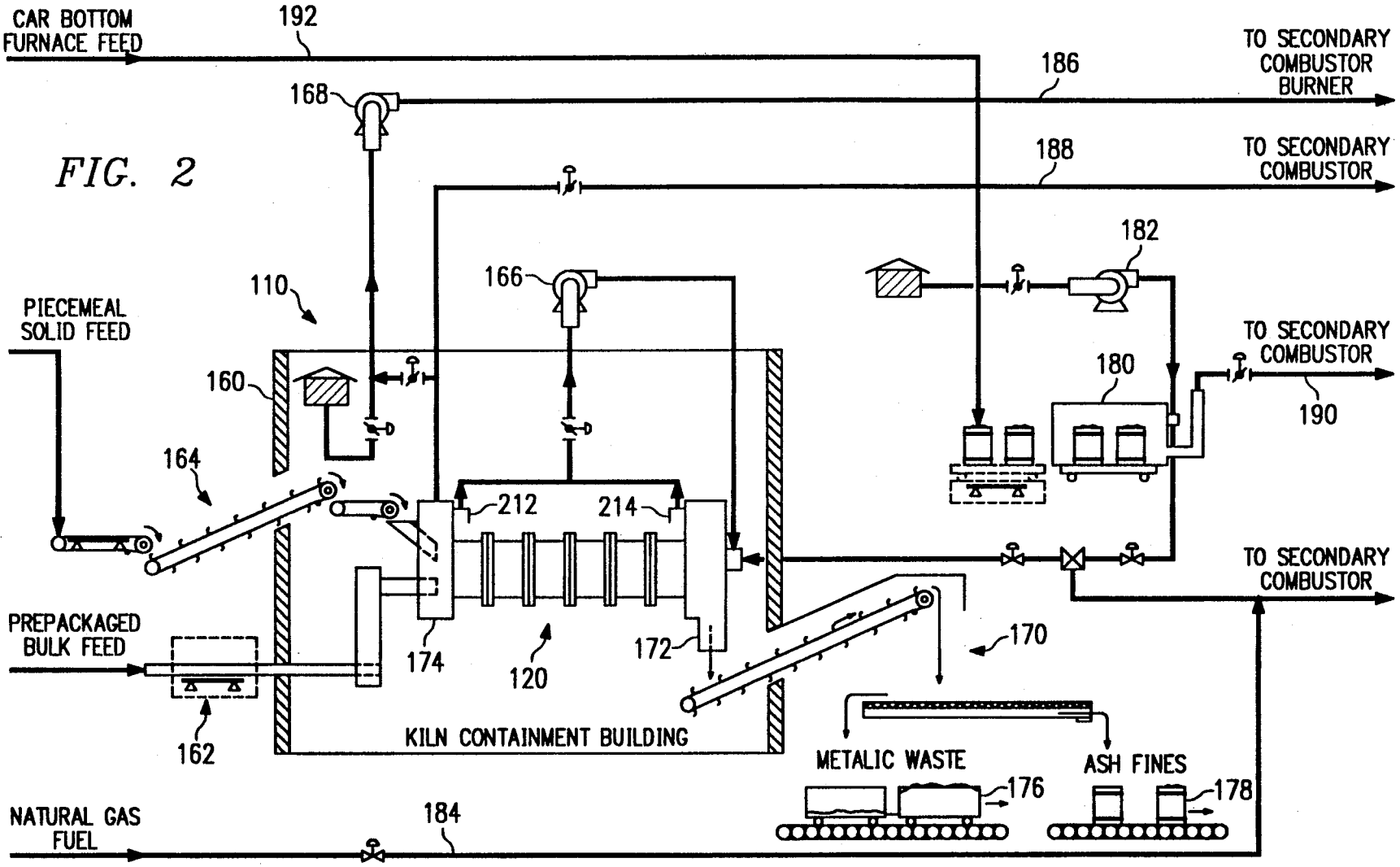
FIG. 2 is a schematic of the rotary kiln within the containment building, the continuous feed and positive feed systems, and the kiln discharge system.

FIG. 2 illustrates the flow paths of hazardous waste, exhaust gases and fuel for incinerator 100. Waste is fed to kiln 120 by one of the two feed systems. The first is a continuous feed system 164. This continuous feed system 164 consists of three conveyors which take a constant flow of loose configured munitions, assembled items, and prepackaged bulk items to feed assembly 174 of kiln 120. The second system is a positive feed system 162 which takes either bulk PEP or sensitive waste to feed assembly 174 of kiln 120 in timed batches. Each batch of waste is packaged in a consumable container which is destroyed by the heat in the kiln. Both systems feed waste through openings in blast wall 160 in containment building 110. Waste proceeds through kiln 120 due to its rotation. The combusted waste consists of ash and recoverable metal scrap. These end products exit kiln 120 through discharge assembly 172 and onto discharge system 170. The waste is separated by a shaker grate and deposited in either ash bin 178 or scrap metal bin 176.

Air is drawn through the kiln 120 by induction draft fans 154 (not shown) via air path 188. A primary combustion air blower 166 circulates fugitive emissions collected in shrouds 212, 214 back into kiln 120. A secondary combustion air blower 168 draws air from the containment building 110 and directs this air to the secondary combustor via path 186.

A car bottom furnace 180 may also be used in incinerator 100. This furnace may be used on an intermittent basis for treatment and decontamination of large, unusual irregular shaped metal pieces, or incineration of rags and soiled uniforms. Fuel is supplied to the kiln burner, car bottom furnace and secondary combustor via line 184. Air is supplied to the car bottom furnace 180 by blower 182. Feed is supplied to the furnace 180 by path 192. Exhaust from the furnace 180 is vented via path 190.

Figure 3:
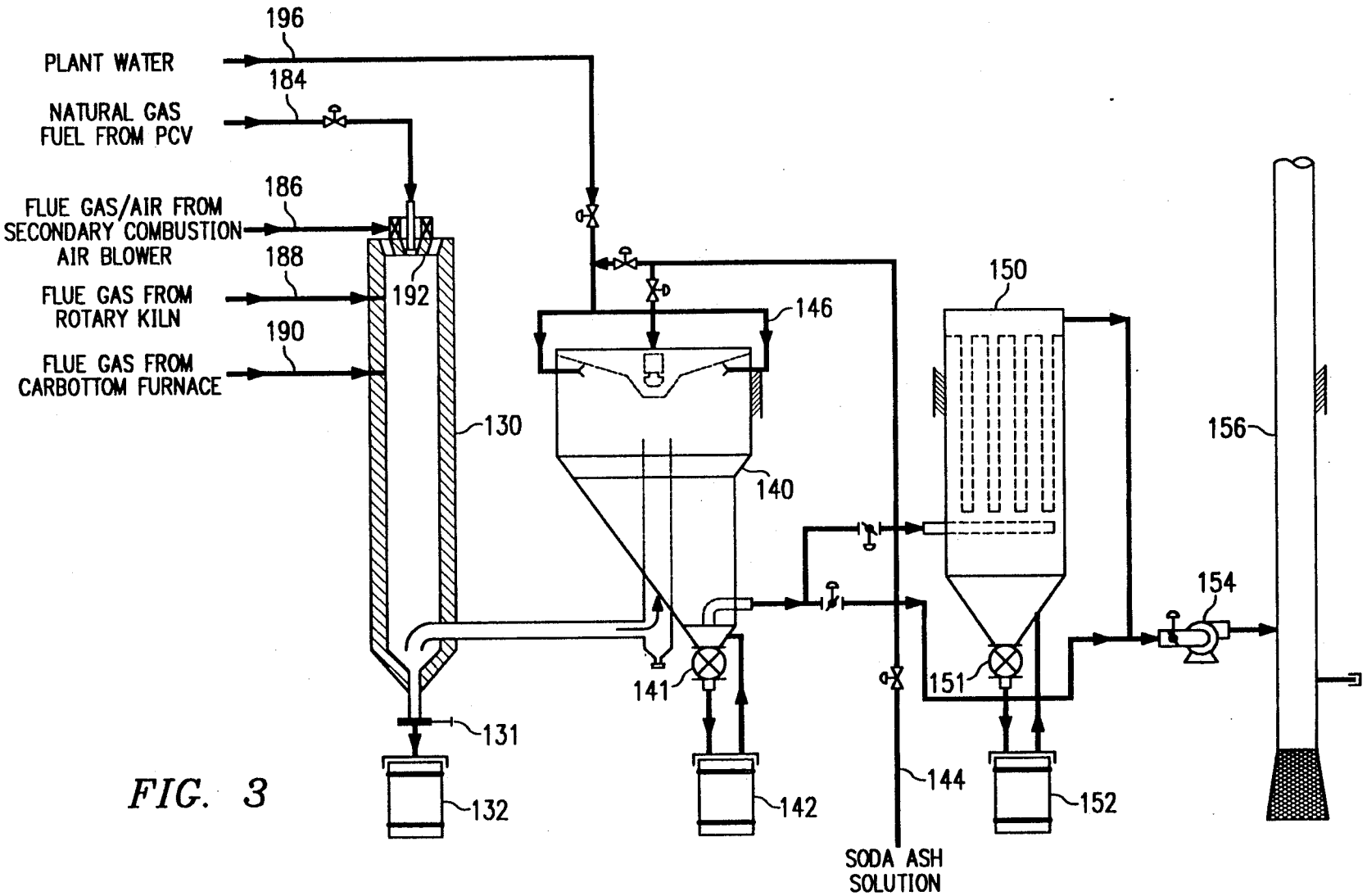
FIG. 3 is a schematic of the secondary combustor, spray dryer, baghouse, and stack.

FIG. 3 illustrates the flow of exhaust gases from kiln 120, containment building 162, and car bottom furnace 180 to the secondary combustor 130, the spray dryer 140, baghouse 150, and the stack 156. Exhaust enters the secondary combustor from the rotary kiln 120 (not shown) via path 188 and from the secondary combustion blower 168 (not shown) via path 186. Flue gas from the car bottom furnace 180 (not shown) enters the secondary combustor via path 190. The secondary combustor 130 is designed to raise the temperature of the exhaust gases to a range of 1200°-2200° F. In a preferred embodiment, the secondary combustor is sized to allow approximately 21,520 cubic feet/minute, and is designed to provide four seconds of residence time under turbulent conditions at the 2200° F. temperature. Residence time would be larger at lower temperatures. The elevated temperature and the residence time of 4 seconds enhances the complete combustion of any organic hazardous constituents in the exhaust gases from the kiln 120. During normal operation the firing rate is nine million btu/hr. The burner is designed for a maximum heat release of twelve million btu/hr. A UV scanner is provided to monitor the flame of the secondary combustor burner.

Since the kiln exhaust gas contains enough air for complete combustion of the waste feed, the only air admitted into the secondary combustor 130 is for the burner fuel. The air for the burner is typically at 10 inches of water column (WC). The design criteria for the secondary combustor 130 results in a large amount of excess air of approximately 100% in the exhaust gases. The oxidizing atmosphere creates additional favorable conditions for total hydrocarbon (THC) destruction, thus minimizing levels of carbon monoxide and product(s) of incomplete combustion (PIC). The secondary combustor 130 is fired with natural gas at an average rate of 9,000 scf/h. The natural gas is injected via line 184 through injector 192. Ash and particulates which collect at the bottom of the secondary combustor 130 are released into drum 132 by valve 131.

In a preferred embodiment, the secondary combustor 130 is constructed of carbon steel and is internally insulated with a combination of modular and ceramic fiber products. Each ceramic fiber module is individually anchored to the secondary combustor casing. The density of the modules is typically greater than 12 lb/cubic ft. density to prevent downstream migration of fibers and are edge grain constructed to resist erosion. A rigidizer/surface coating can be used to treat the ceramic fiber surface. This provides surface hardness and resistance to erosion. The secondary combustor is approximately 10 feet in diameter and 40 feet high.

The air pollution control system (APCS) for incinerator 100 further consists of a spray dryer 140 for conversion of exhaust gas acidic components into sodium salts, followed by a baghouse 150 for removal of entrained particulate matter. The temperature interval where formation of products of incomplete combustion (PICN) may occur is decreased by rapid quenching of the exhaust gases from the secondary combustor 130 from 2200° F. to 350° F. in the spray dryer 140. Concurrently, conversion of the bulk of the acidic components in the flue gas into sodium salts is accomplished by using a soda ash solution as quenching medium. This solution from line 144 is mixed with plant water from line 196 and injected into the spray dryer 140 by nozzles 146. Unconverted acidic components from the spray dryer will react further with soda ash on the surface of the bags in the baghouse 150. A single rotary valve 141 transfers the dry products from the bottom of the spray dryer to a collection drum 142 for offsite disposal.

Reliable operation of the spray dryer 140 depends on the following inter-related key design parameters. First, atomization converts a pumpable fluid into a multitude of discrete fine droplets with high surface area for gas-liquid reactions and evaporation. Atomization can be accomplished through the use of a rotary atomizer or dual fluid nozzles. Second, gas dispersion ensures that intimate contact occurs between the drying media (flue gas) and the atomized droplets (soda ash solution) for rapid heat and mass transfer. The amount of energy required to achieve this mixing varies dependent on chamber geometry, turndown requirements, allowable spray down temperature (temperature across the spray dryer), and the nature of the particulate matter entering the spray dryer. Third, an absorber residence time between 15 and 30 seconds ensures that the reagent and reaction products are sufficiently dried prior to contacting the walls of the spray dryer. Last, the spray dryer outlet temperature is set between 350° F. and 450° F., which is significantly above the dew point temperature, to ensure that the particulate matter including hydroscopic reaction products are dry and free flowing in the downstream located equipment. The spray dryer 140 typically has a diameter between 14 feet and 24 feet and a height of between 40 feet and 50 feet.

After leaving the spray dryer 140 the flue gas typically enters the baghouse 150 which typically contains 30 bags in each of the three modules. Each bag is 6 inches in diameter and 12 ft long thus obtaining approximately 4500 square feet of total filter area with an approximately 3.0 $Ft^2$/min-$Ft^2$ air to cloth ratio. The bag material can be Nomex felt which can be silicone treated, heat set, and flame proofed. The baghouse 150 incorporates a jet-pulse cleaning system with continuous discharge of the collected dust. A single rotary valve 151 transfers the dry products from the bottom of the baghouse 150 to a particulate collection drum 152 for off site disposal. The baghouse 150 typically has an overall width of 10 feet and height of 25 feet for each module. Baghouse 150 may be bypassed if necessary.

The exhaust gases from the baghouse 150 enter the induced draft fans 154 at a maximum temperature of 350° F. The fans are designed to provide adequate movement of gases through the kiln and pollution control devices. In a preferred embodiment, each fan will handle 50% of the total flow. In the event of a single fan failure, the remaining fan will operate at maximum rate. This system will prevent the unintentional release of emissions due to failure of one fan. In addition to two fans, an emergency generator is provided to protect against power failure.

Following the induced draft fans 152, the exhaust gases enter the stack 156. The stack 156 is a key contributor to the emission characteristics of the incinerator 100. In a preferred embodiment, the stack is approximately 215 feet (65 meters) tall and 2 feet in diameter. The stack 156 is constructed from corrosion resistant carbon steel, possibly stabilized by guy wires, outside insulated, and is mounted on a concrete foundation. Condensed water from the stack can be collected in a separator for disposal. The horizontal distance between the stack and the draft fan is typically 10 feet.

It should be noted that liquids/slurries may be fed through an atomizing nozzle 192 into the top of the secondary combustor 130. A special burner assembly (not shown) may be mounted on the top of the secondary combustor 130 where the dilute slurry or emulsion waste will be injected into the hot flame zone of the natural gas burner. In this zone the water evaporates and the combustion of the solid particles provides additional heat for the complete destruction of the POHCS. Excess air to the secondary combustor 130 will be controlled by the secondary combustion air blower 168 (not shown) for the exact requirement of each type of liquid waste. The kiln 120 will typically not be in operation during the incineration of liquid waste streams. Ash content of the liquid wastes will accumulate at the bottom of the secondary combustor 130 and removed periodically.

Figure 4:
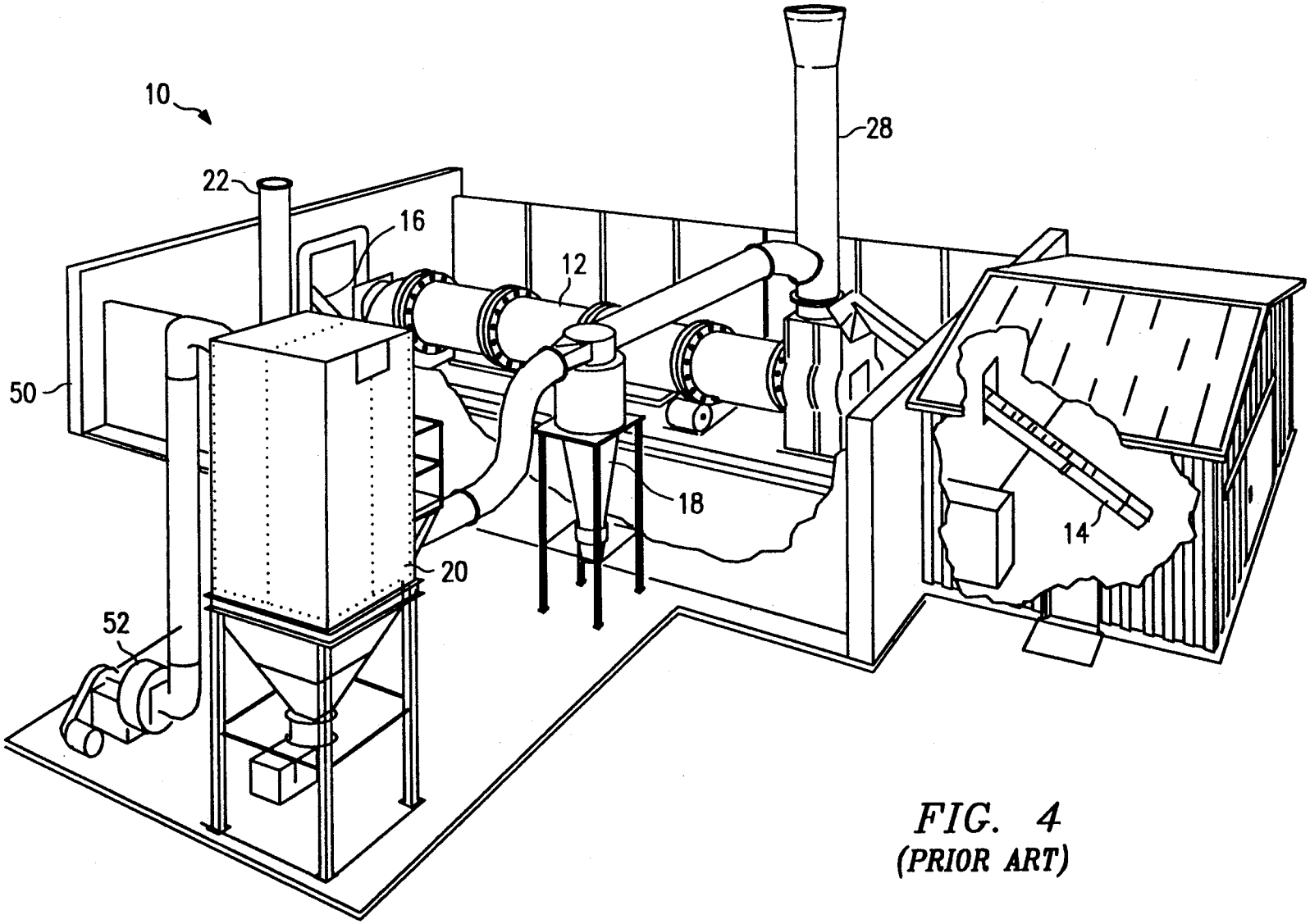
FIG. 4 (PRIOR ART)
FIG. 4 is a perspective view of the APE-1236 prior art incinerator.
Figure 5:
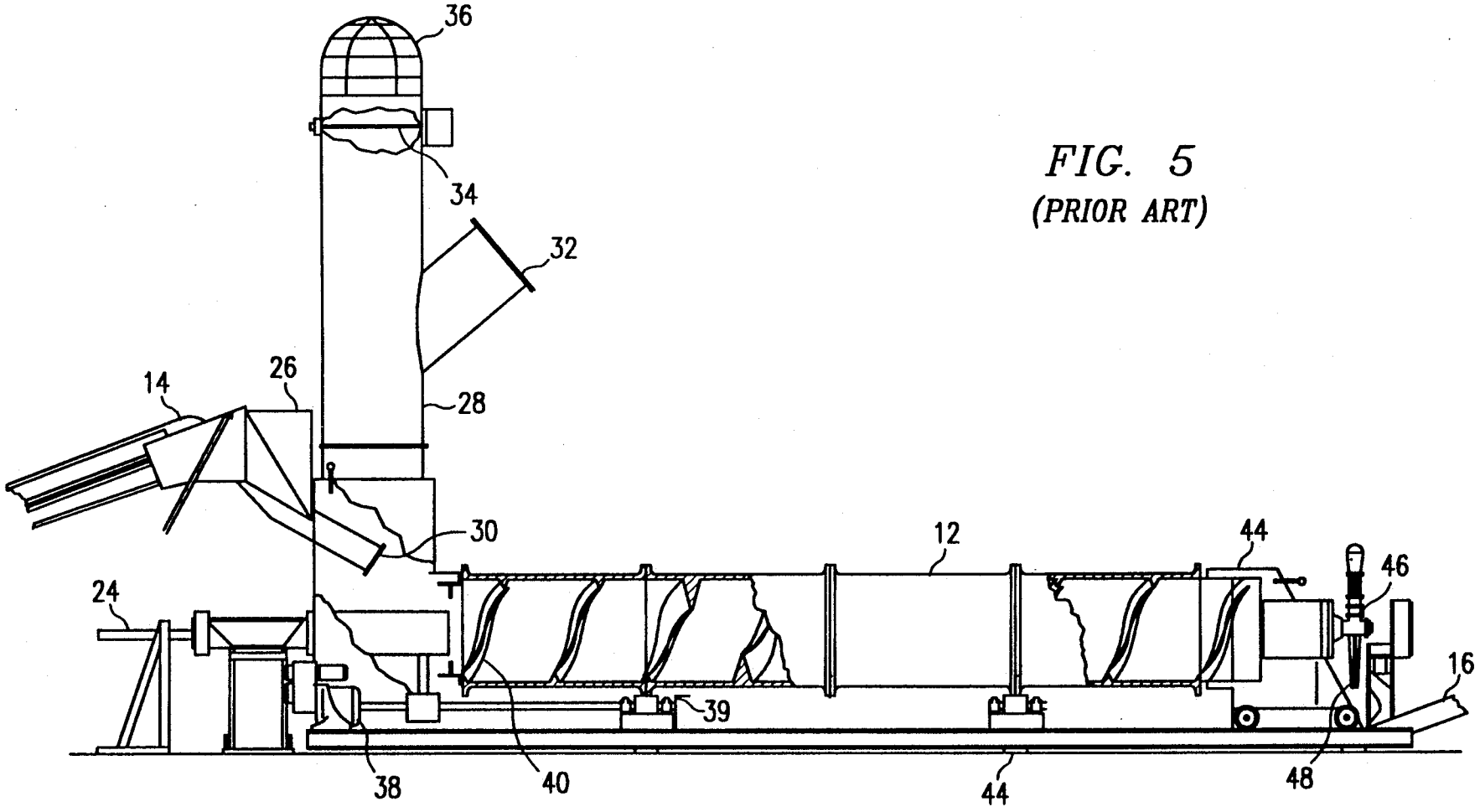
FIG. 5 (PRIOR ART)
FIG. 5 is a sectional view of the APE-1236 prior art rotary kiln.

FIGS. 4 and 5 illustrate the APE-1236 demilitarization incinerator 10 developed by the U.S. Army. This incinerator 10 was comprised of rotary kiln 12 housed in barricaded area 50. Waste was fed to the kiln 12 by conveyor 14. Combusted waste left the kiln on discharge conveyor 16. Exhaust from kiln 12 passed through cyclone 18 and baghouse 20, wherein particulate matter was removed. Induction fan 52 pulled the exhaust to stack 22 from which it was vented to the atmosphere.

Kiln 12 consisted of four retort sections. The first and fourth retort sections have wall thicknesses of 2¼ inches, while the second and third sections have wall thicknesses of 3¼ inches. The kiln rotates on two sets of trunions 39 which are mounted on a furnace frame mounted on concrete pier 44. A single set of trunions 39 is driven by motor and variable drive system 38. Waste enters the kiln 12 by either positive feed system 24 or pan-type conveyor system 14. The positive feed system 24 incorporates a ram to push the waste through feed assembly 30 and into kiln 12. The pan-type conveyor system 14 feeds a steady stream of waste to feed chute 26 which directs the waste through feed assembly 30 and into kiln 12. Once within kiln 12, the waste is carried through the length of rotating kiln 12 by spiral flights 40. Once the waste encounters the discharge end assembly 44, it drops to discharge conveyor 16.

The kiln 12 used in the APE-1236 incinerator is heated by burner 46 and combustion air blower 48, both located near the kiln exit. The air flowed counter to the current of the waste. The exhaust entered exhaust stack 28. The exhaust was then vented to the cyclone 18 via path 32 or to the emergency dump damper 34 and fragment retainer 36. The U.S. Army recently upgraded APE-1236 DF by the addition of an automated waste feed rate monitoring system which controls batches of feed material fed on the continuous feed system or positive feed system, shrouding of the rotary kiln and feed chute to capture fugitive emissions and draw them into the primary combustion air blower for reintroduction into the kiln, an afterburner or secondary combustor capable of elevating the exhaust gases up to 2000° F. and providing a one second residence time at 1800° F., a high temperature gas cooler to reduce exhaust gas temperatures from 2000° F. to 850° F., a low temperature gas cooler to further reduce exhaust gas temperatures from 850° F. to approximately 300° F., a baghouse bypass system to prevent condensation of moisture in the baghouse during start-up of the system, a larger induced draft fan, continuous exhaust gas monitoring equipment for monitoring CO, $O_2$, and exhaust gas velocity, a new distributive control system with computer controlling and report generating capabilities, and primary and secondary feed conveyor system. The upgrade also eliminated the emergency dump stack.

Figures 6, 6A, 6B:
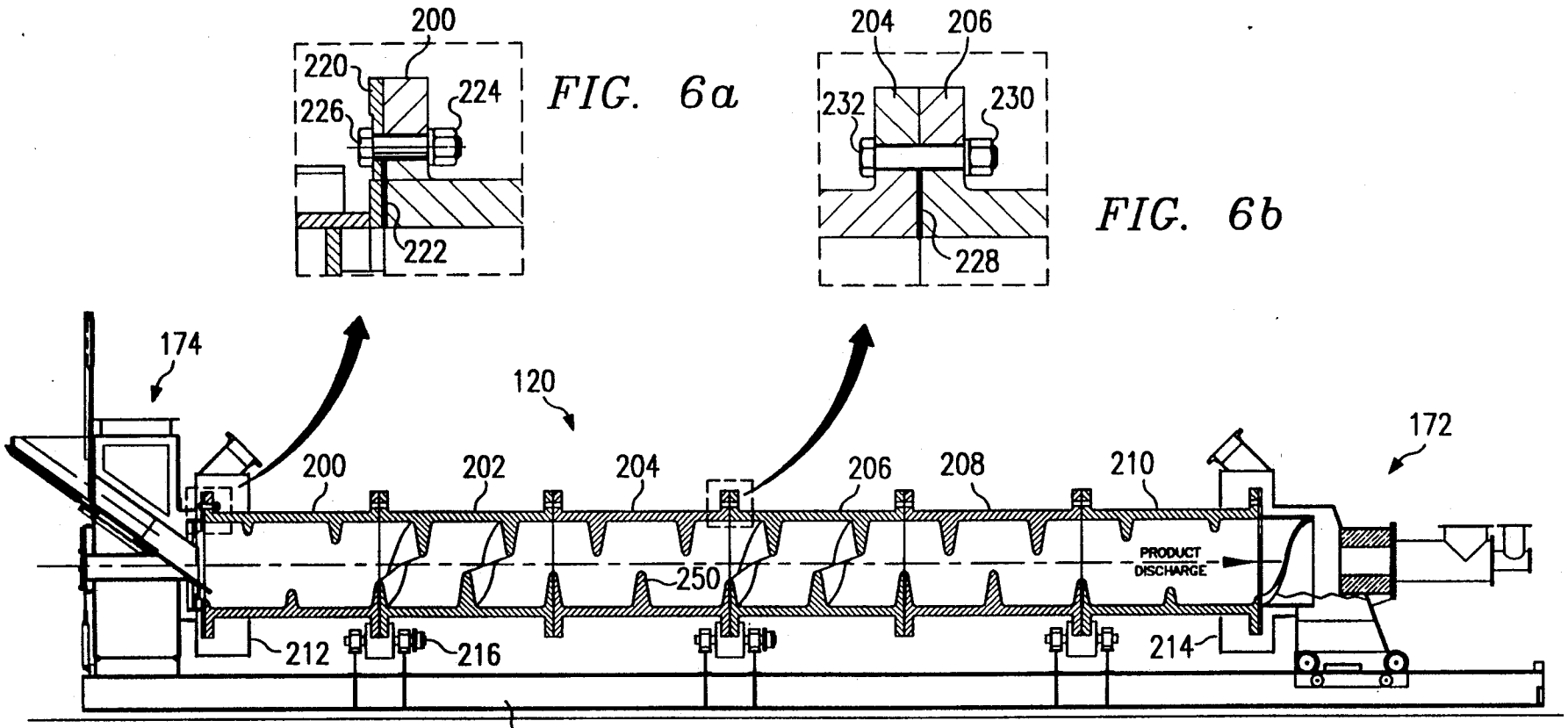
FIG. 6 is a sectional view along the length of the rotary kiln used with the present incinerator.
FIG. 6A is a detail view illustrating the attachment of the rotary kiln and the charge plate.
FIG. 6B is a detail view illustrating the seal between individual retort sections.

FIG. 6 illustrates the rotary kiln 120 used in incinerator 100. The rotary kiln 120 is also referred to as a retort or as having retort sections. The rotary kiln 120 is a deactivation furnace designed with internal spiral flights 250 which advance the waste as the kiln rotates and hinder explosive propagation. The flights also increase the mixing of the waste material in the retort with the combustion air, thus increasing the combustion efficiency and effectiveness. In a preferred embodiment, the retort is 30 feet long and is constructed of ASTM A217-65 grade WC-9 cast steel for high strength and ductility at elevated temperatures. The overall length of the unit including charge assembly 174 and discharge assembly 172 is approximately 46 feet. The retort is made up of six 5-foot sections 200, 202, 204, 206, 208, and 210 that are bolted together. All six sections have 3¼ inch thick walls. The nominal diameter of the retort is 36 inches.

The cross-sectional area of the retort is 4.6 square feet. This gives a total combustion volume of 109.2 cubic feet. The outlet flue gas flow rate of the kiln is approximately 3,850 acfm resulting in a gas residence time of less than one second.

Shrouds 212, 214 are located, respectively, at both the feed entrance and exit of kiln 120. Shroud 212 covers the interface between the kiln feed ingress and the feed assembly. Shroud 214 covers the interface between the kiln feed egress and the discharge assembly. A charge plate 220 is also bolted to retort section 200 by a plurality of bolts 224 and nuts 226. A gasket 222 is located between charge plate 220 and retort section 200. The gasket is typically 1/16 inch thick. Similarly, each retort section is bolted to its adjacent sections by a plurality of bolts 230 and nuts 232 with a similar gasket therebetween.

Parameters such as residence time, operating temperature and pressure, and excess air are crucial to the performance of the kiln. Residence times of the material in the retort are set by the kiln's rotational velocity. The retort is equipped with a variable speed system which allows the retort to turn at different speeds, ranging from 0.5 to 3.5 rpm. Typically, if the kiln rotates at one rpm, the waste will have a residence time of approximately twelve minutes. Likewise, at 2 rpm, the waste residence time is about 6 minutes.

The selection of the operating temperature depends on the type of waste that is to be incinerated. At the hot burner end of the retort the temperatures can range from 800° to 1400° F. At the cold end, where the feed enters and the flue gas is discharged, temperatures range from 300° to 700° F. This counter-current feed versus firing operation helps to prevent premature detonation of munitions and promote even burning along the length of the retort.

The kiln 120 is provided with a single burner assembly 121. A natural gas burner is used during the destruction of solid waste to sustain the operation of the kiln. The fuel consumption will vary with the specific waste material to be processed. This single burner is designed to develop a thermal loading of 4,000,000 btu/hr at maximum firing. When a high heat content feed material is incinerated, natural gas will only be required to support the pilot which requires approximately 75,000 btu/hr of fuel. The burner is equipped with all accessory equipment necessary in the burner operation. A UV sensor, acting as a flame failure safety device, detects the burner flame at the burner tip.

Operating pressure is a key factor because of the difficulty of creating a seal between the kiln 120 and the end assemblies 172, 174. The retort, the shrouds, and the kiln containment building are each operated under a slight negative pressure to optimize operating pressure. The negative pressure of −0.1 to −1.0 inch WC in the retort results in up to an additional air flow of 3500 acfm being drawn into the kiln 120 via the feed and discharge openings. Each end of the kiln 120 is covered by a carbon steel shroud 212, 214 to collect fugitive emissions. The fugitive emissions are recirculated back into the retort 120 by drawing a maximum combustion air flow of 1100 acfm through both shrouds with the primary combustion air blower (not shown) for discharge to the kiln burner at +10 inch WC. Also, the kiln containment building is maintained at −0.1 to −0.5 inch WC. Therefore, kiln 120 always operates under extremely high excess air conditions for establishing a uniform temperature profile along the retort.

Figure 7:
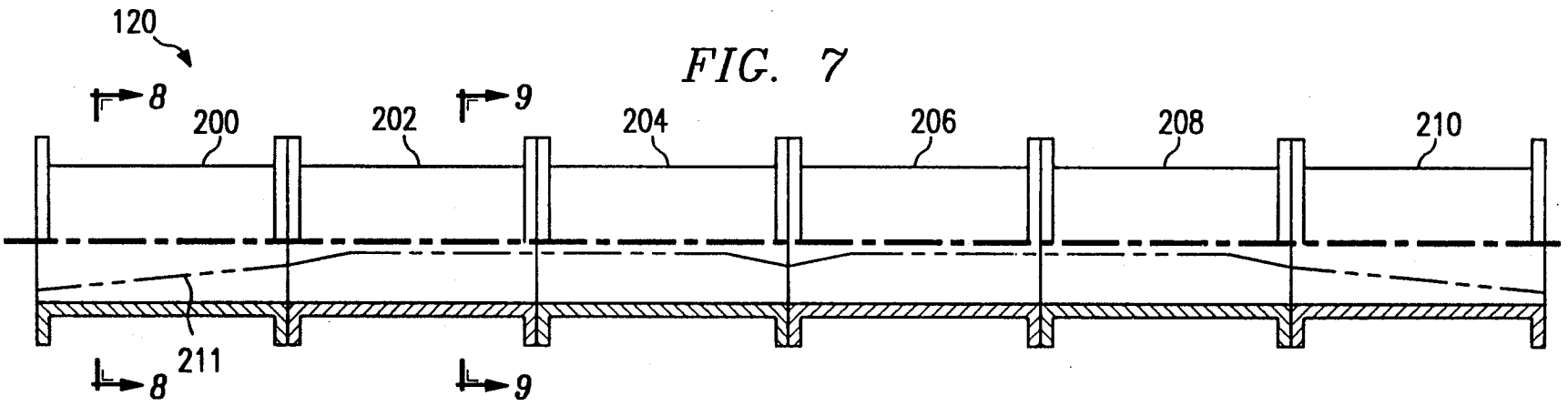
FIG. 7 illustrates the placement of the two types of retort sections and their varying choke.
Figure 9:
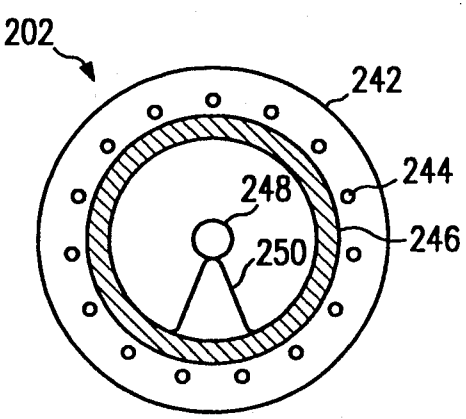
FIG. 9 is a sectional view across the width of the kiln showing the choke of a type B retort section.
Figure 8:
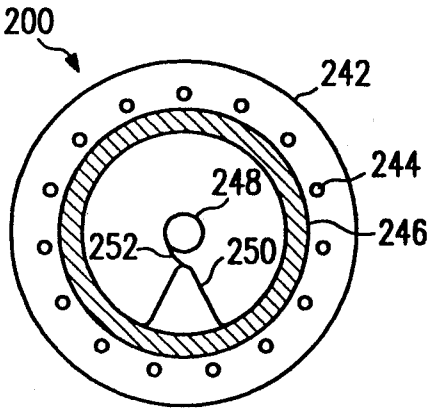
FIG. 8 is a sectional view across the width of the kiln showing the choke of a type A retort section.

FIGS. 7, 8 and 9 illustrate the unique configuration of the retort sections 200, 202, 204, 206, 208, and 210 and the choke of the spiral flight 250 within. Line 211 represents the height of the spiral flights along the length of the kiln 120. As can be readily noted, retort sections 200 and 210 differ from retort sections 202, 204, 206, and 208. The former are referred to as "type A" sections and the latter are referred to as "type B" sections. The type A retort sections have spirals uniformly spaced 30 inches apart from the inside diameter of the retort section regardless of spiral height. The spiral height begins at 3 inches and increases uniformly to a height of 9 inches over the length of the section. The type B retort also contains spiral flights spaced 30 inches apart. However, the type B retort spiral height transitions from 9 inches to 12 inches in the first 180° of flight curvature. The spiral remains a constant 12 inches until its end.

The kiln 120 is constructed of separate retort sections to minimize cost. If an explosion within the kiln damages a section, it can be unbolted and replaced. The sections with taller spiral flights are used in the four central sections. If waste material is to detonate it would primarily occur in the central sections. Due to the temperature gradient along the kiln 120, section 200 is the coolest portion of the kiln 120. Moreover, if the waste were to detonate, it will probably detonate before reaching section 210. Therefore, the taller flights create a smaller choke within the helix 250. The tighter choke deters any accidental detonation from propagating to explosive material elsewhere in the kiln 120. The larger choke facilitates the loading and unloading of waste material. FIG. 8 illustrates the choke across cross-section 8—8 passing through section 200 in FIG. 7. Line 252 represents the top edge of the increasingly tall flight 250. Line 248 represents the smallest choke within the length of kiln 120. Also, shown are bolt holes 244 in flange 242 of retort section 200. Line 246 represents the outside diameter of the retort section. FIG. 9 is a sectional view of kiln 120 across line 9—9 in section 202, wherein the spiral flight 250 is at its tallest.

Figure 10:
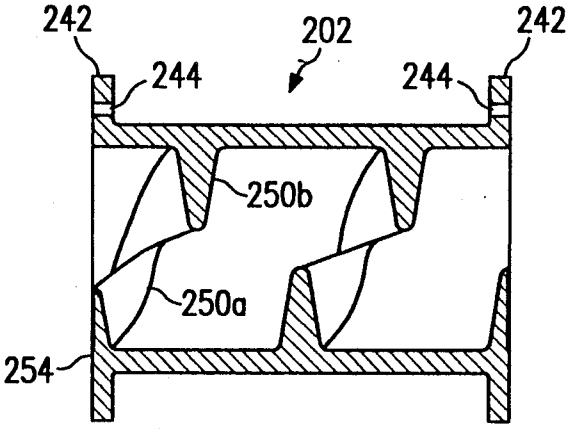
FIG. 10 is a detailed sectional view of a type B retort section.

FIG. 10 provides a detailed view of a type B retort section such as section 202. The section, in a preferred embodiment, has a 36-inch outer diameter. The flange 242 has an outer diameter of 50 inches. Bolt holes 240 penetrate flange 242. Flight 250*a* is 9 inches tall but reaches a height of 12 inches within 180° of rotation as shown by flight 250*b*. Filet 254 is provided to allow for thermal expansion of the flights.

Figure 11:
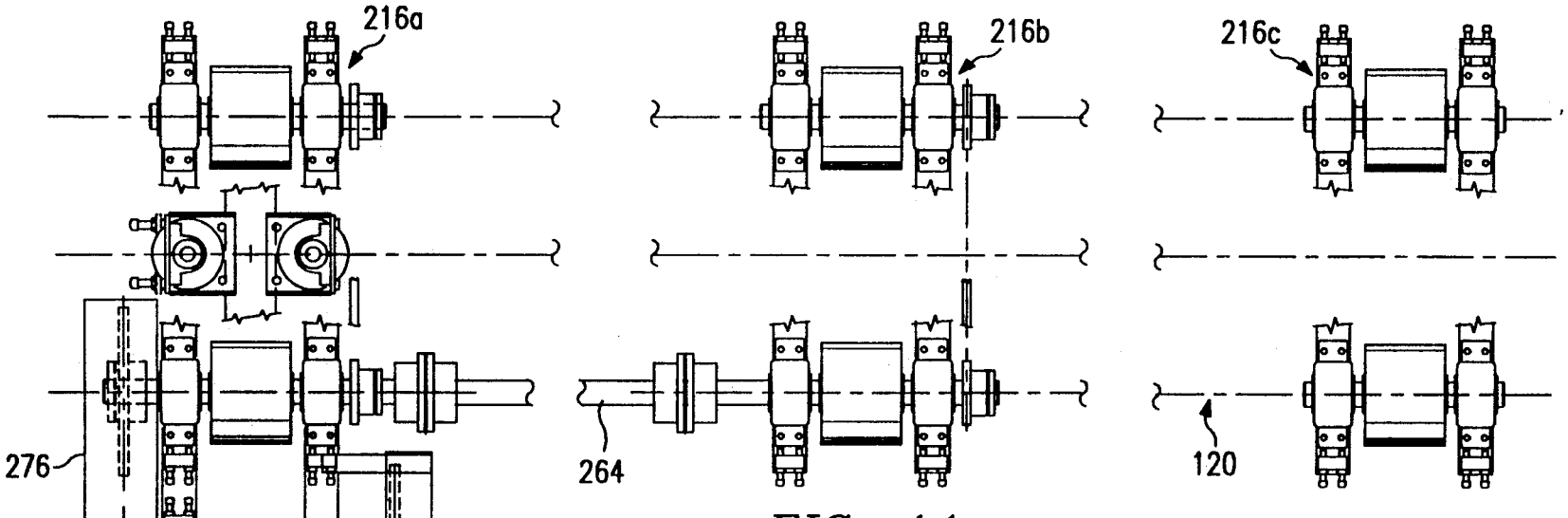
FIG. 11 is a view of the drive mechanism used to rotate the rotary kiln.
Figure 12:
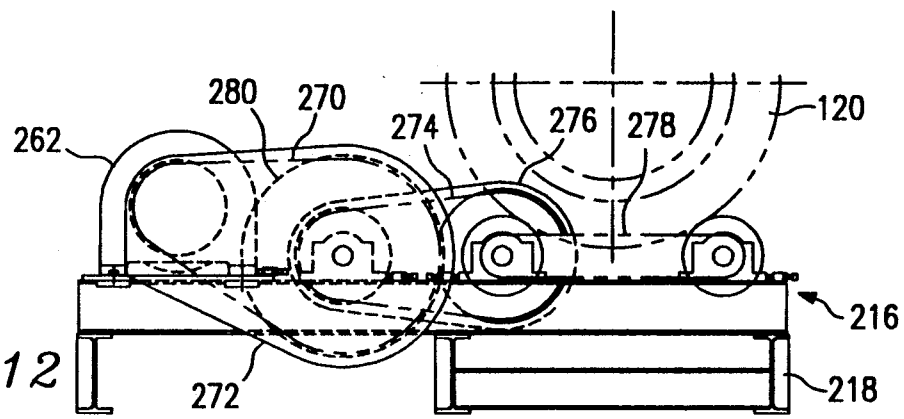
FIG. 12 is a side view of an individual trunion.

FIGS. 11 and 12 illustrate the drive mechanism for kiln 120. Kiln 120 (shown in partial outline) rests on three pair of trunion assemblies 216*a*, 216*b*, and 216*c* spaced evenly along the length of kiln 120. Each set are attached to frame 218. A variable speed drive motor 264 allows the trunions to rotate the kiln at speeds between 0.5 to 3.5 rpm. A sprocket wheel 280 is located between the drive motor 262 and the driven wheel of the trunion 216*a*. Roller chain 270 connects the motor 262 and the sprocket wheel 286. Sprocket wheel 286 is connected by a shaft to wheel 286*a*. Roller chain 274 connects the wheel 286*a* and the driven wheel of trunion 216. Chain guards 272 and 276, respectively, cover each roller chain. Roller chain 278 connects the two rotating wheels of each trunion 216. Shaft 264 transmits power to trunion set 216*a* and 216*b*. Trunion set 216*c* is undriven.

Figure 13:
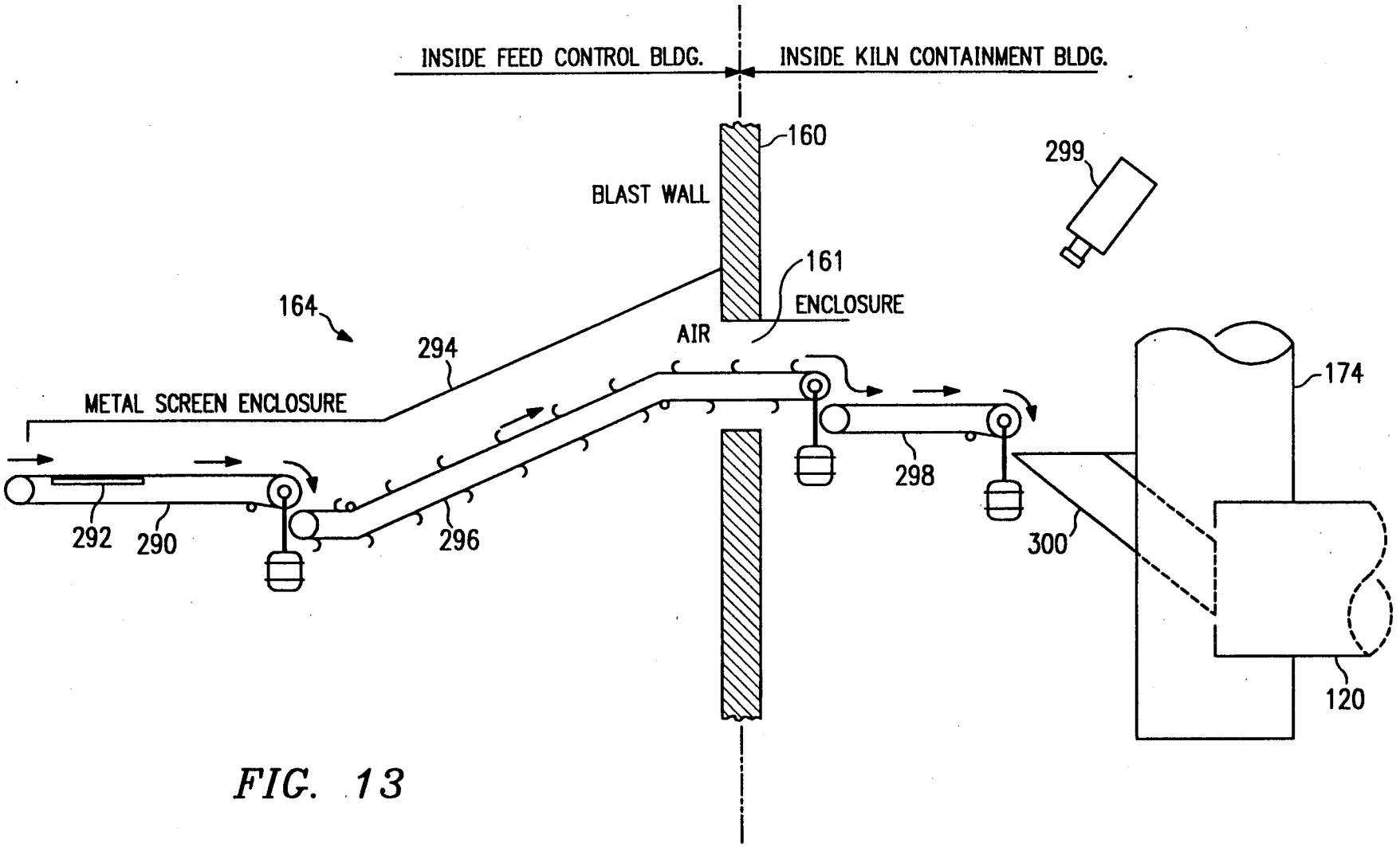
FIG. 13 is a perspective view of the continuous feed conveyor system.

FIG. 13 illustrates the continuous feed system 164 which consists of a loading conveyor 290 with an integrated belt scale 292 for feed rate monitoring, a primary waste feed conveyor 296 and a shorter charge conveyor 298. The primary waste feed conveyor 296 transports material from the load conveyor 290 and belt scale 292 located at grade, through opening 161 in blast Wall 160, and to the short kiln charge conveyor 298. The kiln charge conveyor 298 transports the material into the elevated feed chute 300 of feed assembly 174 at the low temperature inlet of the rotary kiln 120. Should the automatic waste feed cutoff system be activated by the loading conveyor integrated belt scale 292 or a downstream process monitor, the slow speed primary waste feed conveyor 296 is stopped. However, as a safety precaution the higher speed secondary charge conveyor 298 will continue operating to allow feed material near the kiln to continue into the retort, and deter possible explosions outside of the furnace. Progress of the material is monitored by camera 299.

The loading conveyor 290 is typically 6 feet long and 8 inches wide. The kiln feed conveyor 296 is 18.5 feet long and 8 inches wide. The kiln charge conveyor 298 is 6 feet long and 8 inches wide. All conveyors have positive gear drives and independent motors. The flights on the conveyors are spaced at 18 inches along the length, and all conveyors are capable of supporting a 40 pound load per linear foot. The operation of the kiln feed conveyor is controlled by the belt scale 292. The belt scale 292 will not activate the kiln feed conveyor if the feed rate is in excess of a preset value. The conveyance system is covered with a metal screen enclosure 294 to prevent loading of material before and after the belt scale 292. Larger or bulk packaged highly energetic PEP or other types of reactive waste as defined by 40 C.F.R. § 261.23 can also be fed to the kiln on the feed conveyor.

Figure 14:
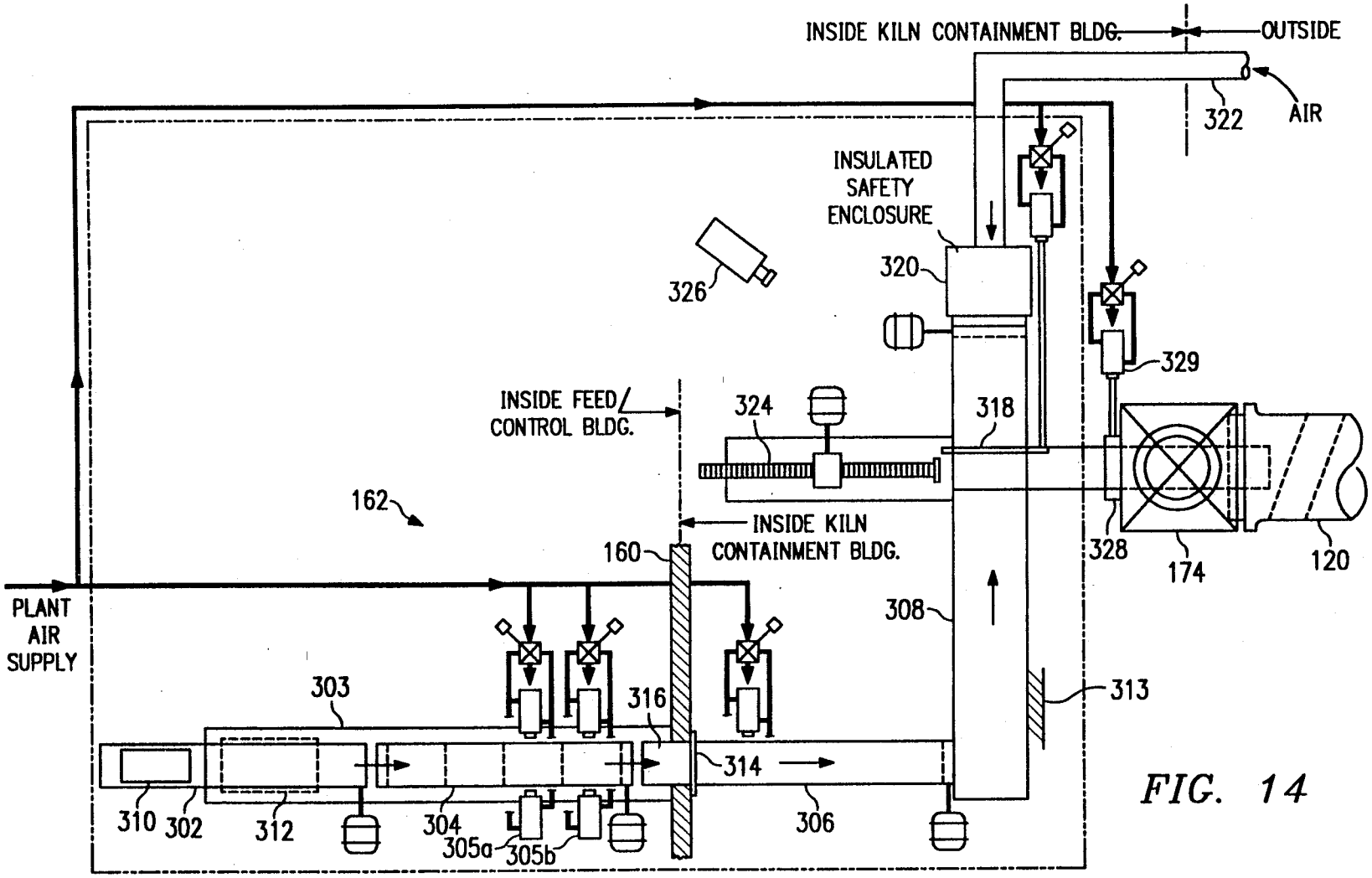
FIG. 14 is a perspective view of the positive feed conveyor system.

FIG. 14 illustrates the positive feed system which consists of elements including a weighing conveyor 302, a pacing conveyor 304, an input conveyor 306, a transfer conveyor 308, a feed ram 324 and a safety enclosure 320. A portion of weighing conveyor 302 and the entire length of pacing conveyor 304 are covered by enclosure 303. Waste is placed onto weighing conveyor 302 in a consumable box 310. The box 310 is made of low particulate, low acid cardboard. The weighing conveyor 302 will incorporate a belt scale 312 for monitoring the weight of each box 310 of hazardous waste. A weight limit is established for each box based upon the type of waste contained therein and the regulations applicable to that waste material. During the weighing process, provisions will be made to remove from the enclosure 303 any box which exceeds the weight limit. The weighing conveyor 302 would then have to be reset before another box moves into the weighing enclosure. Upon demand, acceptable boxes will then be transferred to the pacing conveyor 304.

The pacing conveyor 304 will operate continuously at low belt speed. A maximum of four boxes 310 will be staged on the belt. The pacing conveyor 304 will incorporate two box holding devices 305*a*, 305*b*. One box will be held in the ready position waiting to be released during the next injection cycle while the other boxes are held, waiting to move into the ready position.

The input conveyor 306 transports the box from the holding device 305*b*, through the blast wall 160 and on to the transfer conveyor 308. For safety considerations, a shield door 314 at the blast wall 160 will close off the opening above the input conveyor. The input conveyor 306 will have guide rails (not shown) and will be elevated slightly higher than the transfer conveyor 308.

The transfer conveyor 308 will transport the box 310 to its injection position. An insulating wall 313 is adjacent said transfer conveyor 308 and inhibits heating of box 310 as it approaches kiln 120. The retractable feed fence 318 above the transfer conveyor 308 is used to align the box for injection. Under emergency shutdown conditions the feed fence 318 will be retracted and the box will be conveyed into the safety enclosure 320. The safety enclosure 320 is provided with means to introduce outside air via line 322 thereby cooling the waste and preventing detonation or deflagration. With the box 310 in the injection position, the ram 324 waits for a signal from a sensor on the revolving retort 120. The retort signal ensures that one revolution has been completed and the spiral flight of the rotary kiln is in the proper position to receive the box. Upon receipt of the signal, pneumatic cylinder 329 opens furnace door 328 and the feed ram 324 accelerates the box through the feed assembly 174 and into the retort 120. After the ram returns, pneumatic cylinder 329 closes furnace door 328 and the process is ready to be repeated. Sensors will be utilized throughout the process to identify transfer problems, to ensure the safe operation of the system. Further, camera 326 monitors the insertion of box 310 into feed assembly 174. Typically, all conveyor belts will be conductive and all equipment grounded to minimize the chance of static discharge.

Figure 15:
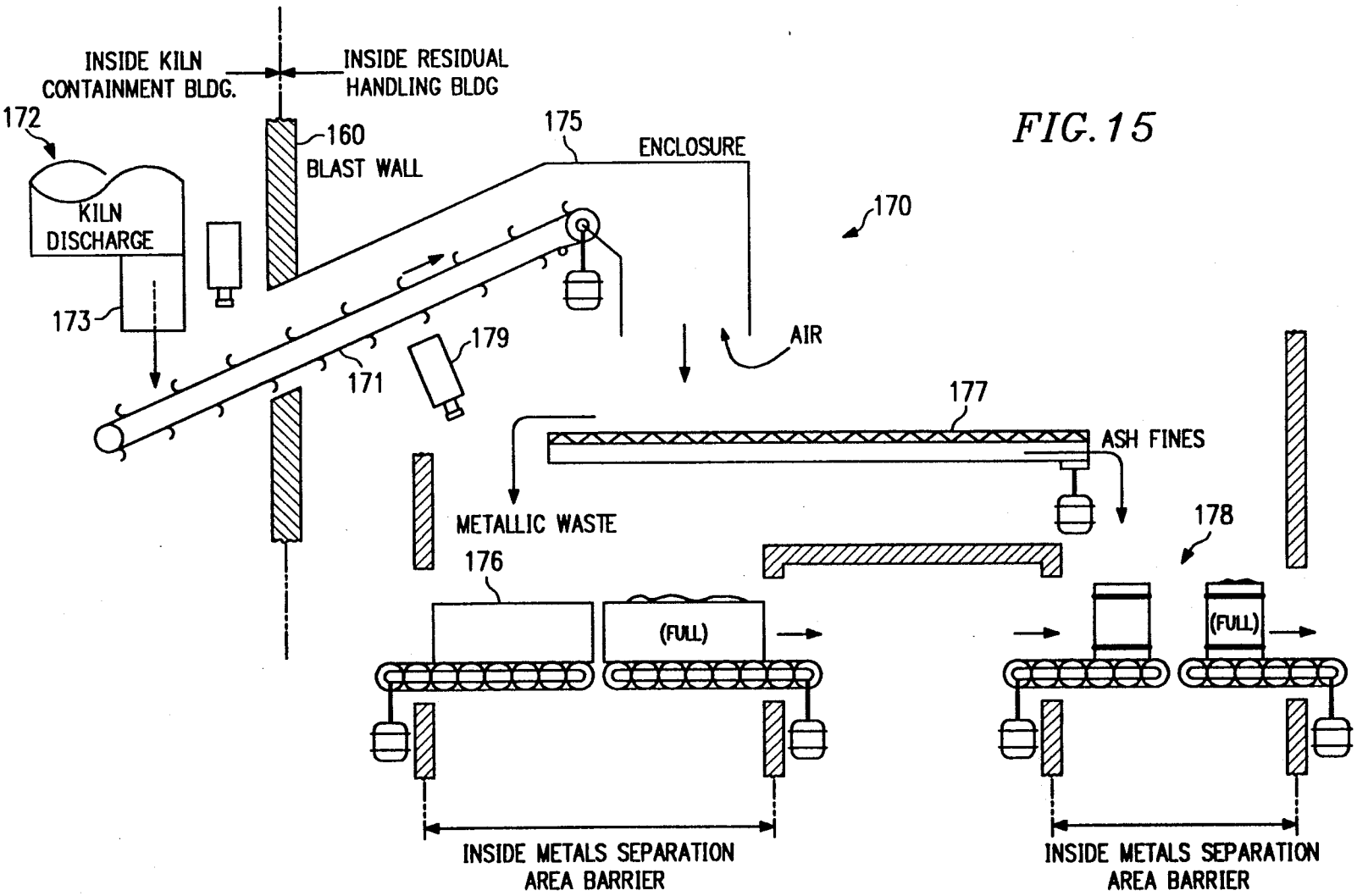
FIG. 15 is a perspective view of the kiln discharge conveyor system.

FIG. 15 illustrates the waste discharge handling system 170. The discharge system 170 accepts waste from the discharge assembly 172 through discharge chute 173. The destroyed waste, or discharge, is deposited onto discharge conveyor 171 which is covered by an enclosure 175. Conveyor 171 deposits the destroyed waste onto shaker grate 177 which separates the discharge into metallic waste or ash. The metallic waste is deposited into bins 176 while the ash is deposited into bins 178. The process is monitored by camera 179. Combustion air is drawn through the enclosure 175 and introduced into the kiln 120. The discharge conveyor 171 is typically 20 feet long and 18 inches wide and is capable of supporting a 40 pound load per linear foot. The flights on conveyor 171 are spaced at 18 inches. The metal pieces and any residual ash are exported to a scrap metal facility for reprocessing of the metals.

Figure 17:
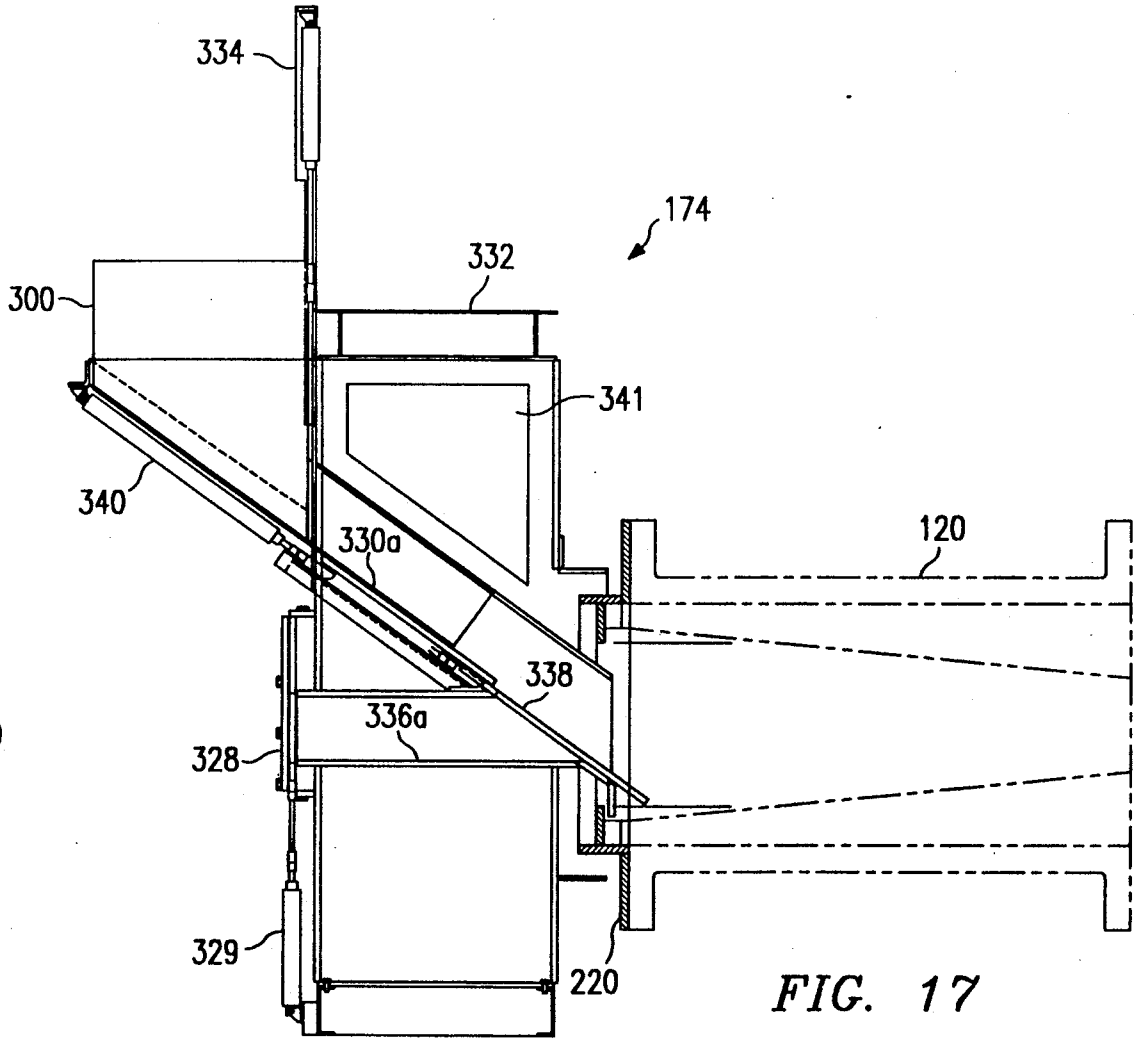
FIG. 17 is a side view of the kiln feed assembly.
Figure 16:
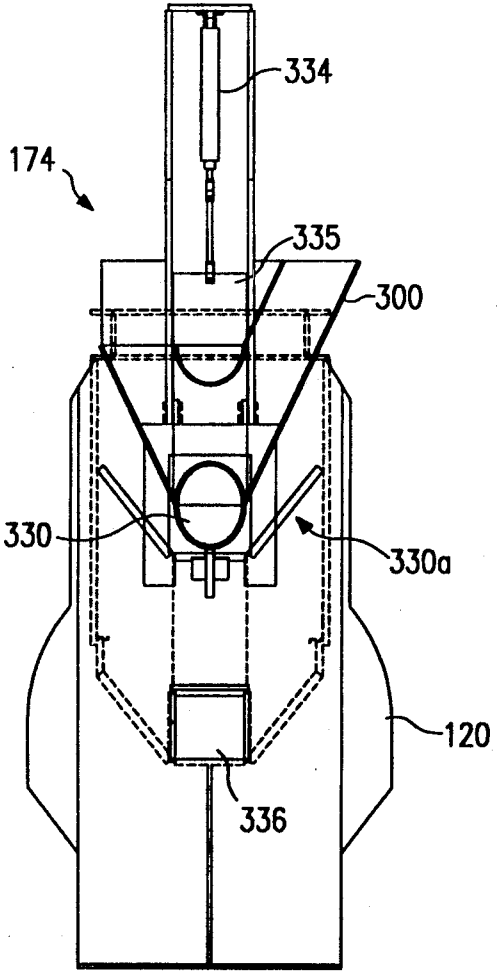
FIG. 16 is an end view of the kiln feed assembly.

FIGS. 16 and 17 illustrate feed housing 174. This housing has a number of advantages of the one used on the APE-1236 deactivation furnace. The feed housing or assembly 174 incorporates the capability to change from the conveyor feed system 164 to the positive feed 162 system without shutting down and cooling the furnace. Feed assembly 174 has two openings 330, 336 leading to the kiln 120. Each orifice opens to a trough 330*a*, 336*a* which provides a path through the assembly 174. The actuation of a pneumatic cylinder 329 moves a sliding door 328 from a position covering the input orifice 336 for the positive feed system 162. Pneumatic cylinder 340 moves a sliding door 338 from a position over the distal end of trough 336*a* adjacent kiln 120. Pneumatic cylinder 334 moves a sliding door 335 from a position over input orifice 330. Proper positioning of the doors 328, 335 and 339 will be continuously monitored to ensure it is in the proper position for the feed system being used. Feed chute 300 funnels feed toward orifice 330. In a preferred embodiment, a pipe (not shown) extends from chute 300 through orifice 330 and over trough 330*a*. This pipe provides a lower temperature path for the waste feed than trough 330*a*.

The rear wall of the feed housing 174 is designed to fit over the end plate 220 which is bolted to the end of the kiln 120. Troughs 330*a* and 336*a* penetrate the opening in plate 220. Thus, items kicked out of the kiln 120 into the feed housing 174 will slide down the inclined walls of the feed housing back into the kiln 120. Combustion air can enter feed assembly 174 through the gaps between troughs 330*a*, 336*a* and plate 220. This combustion air and entrained exhaust gas, collectively known as flue gas, is pulled out of the feed assembly 174 through port 332 by induction draft fans 154 (not shown). Doors 341 on the sides of the feed housing 174 provide access to its inside, and provide a pressure relief capability in the event overpressures from an unexpected detonation in the kiln exceed those that the APCS is designed to withstand. The new feed housing also includes a redesign of the end plate 220 that bolts to the end of the kiln 120 to increase the cross-sectional area through which exhaust gases can flow from the kiln, thereby increasing the capacity of the furnace system.

Figure 19:
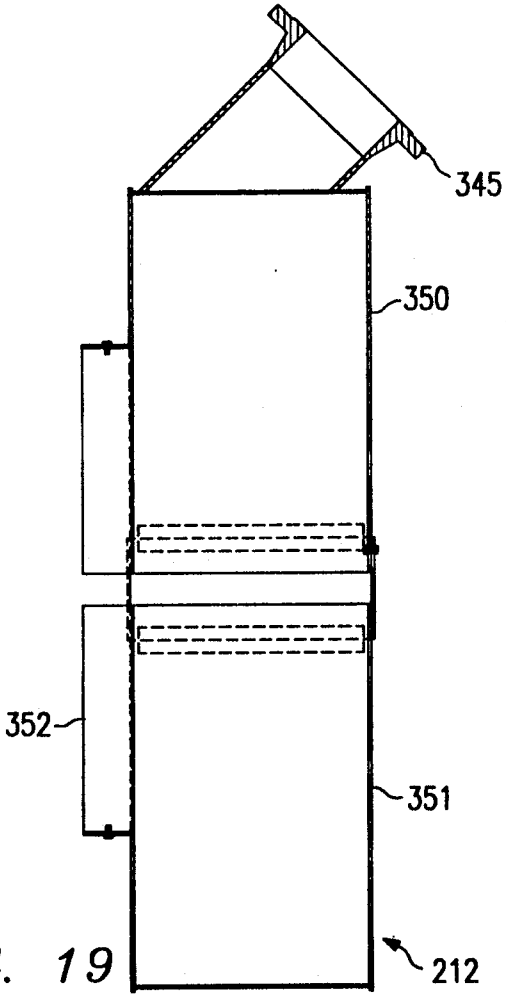
FIG. 19 is a side view of the shroud.
Figure 18:
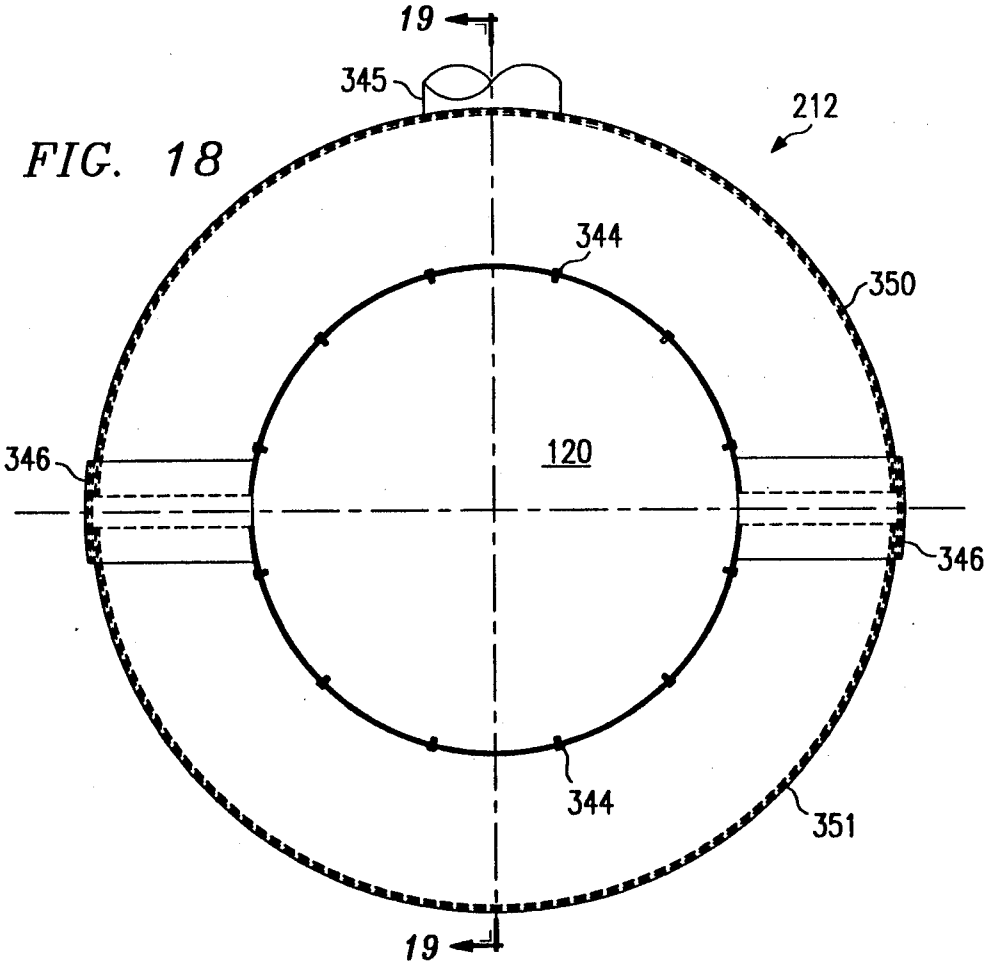
FIG. 18 is a front view of a shroud.

FIGS. 18 and 19 illustrate the shroud 210, 212 which cover both ends of kiln 120. As earlier discussed, these shrouds capture fugitive emissions which leak through the seals between the kiln 120 and the end assemblies 172, 174. The shrouds 210 and 212 are identical and are typically comprised of two halves 350 and 351 which are attached by caps 346. The shrouds are generally circular and hollow with an exhaust pipe 345 extending from upper section 350. Exhaust pipe 345 connects to primary combustion blower 166. Tab plates 352 extend from the shroud sections 350 and 351. The tab plates 352 are dimensioned to attach to the feed assembly 174. Bolts 344 attach the tab plates 352 to assembly 174.

Figure 21:
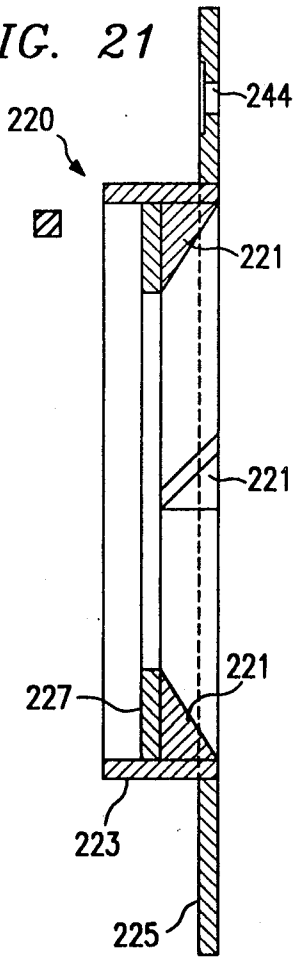
FIG. 21 is a side view of the charge plate.
Figure 20:
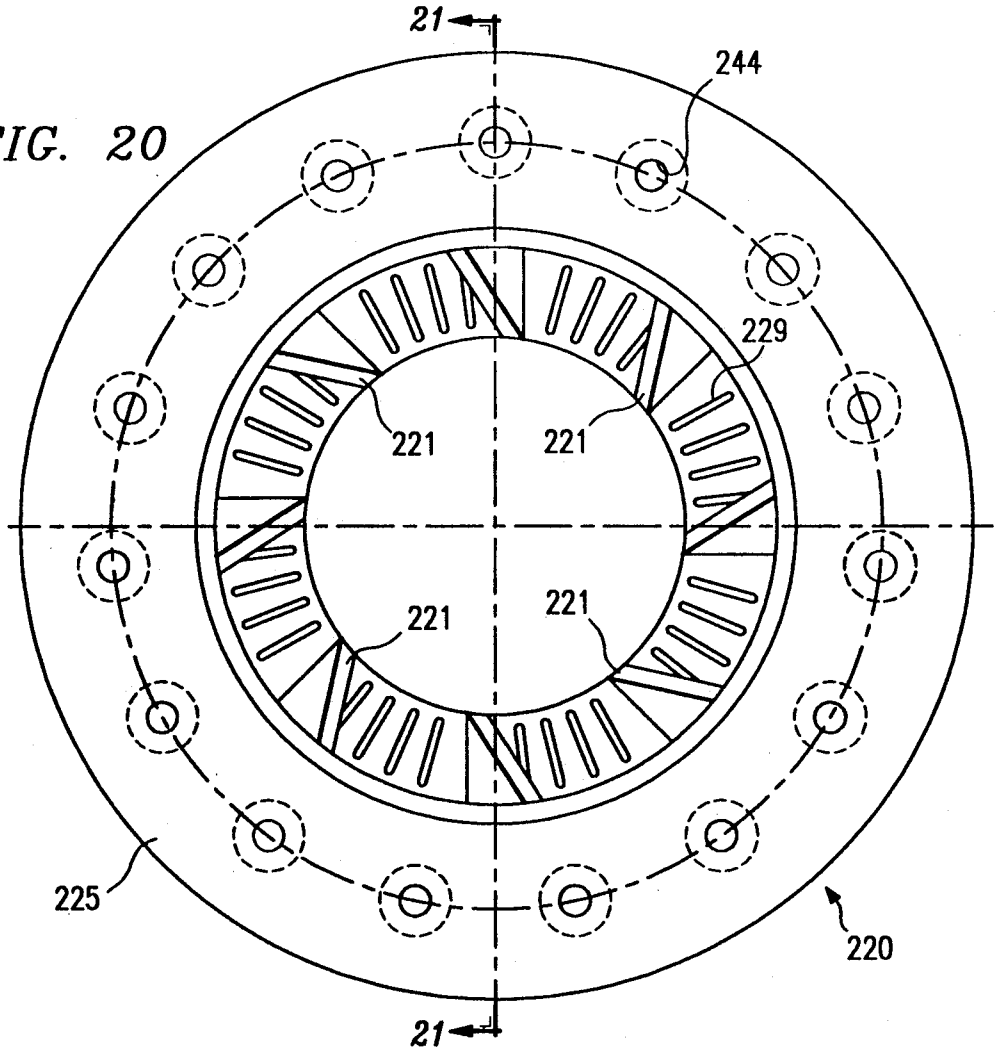
FIG. 20 is a front view of the charge plate at the kiln ingress.

FIGS. 20 and 21 disclose charge end plate 220. The charge plate 220 is comprised of flange portion 225, with a ring 223 perpendicularly attached thereto. Baffle 227 is perpendicularly attached to ring 223. A plurality of wedges 221 are attached adjacent both ring 223 and baffle 227. Charge plate 200 is a generally circular plate with a concentric hole therethrough. The hole corresponds to the opening in retort section 200. Bolt holes 244 in flange portion 225 match holes in the flange 242 in retort section 200. Wedges 221 help dislodge any waste feed that might not fall into the kiln. As the kiln 120 and the charge plate 220 rotate, any errant waste would roll along the ring 223 until it encounters a wedge 221 which will urge the waste into the kiln. Slots 222 penetrate charge plate 220 to increase the area for exhaust gases to flow through.

Figure 22:
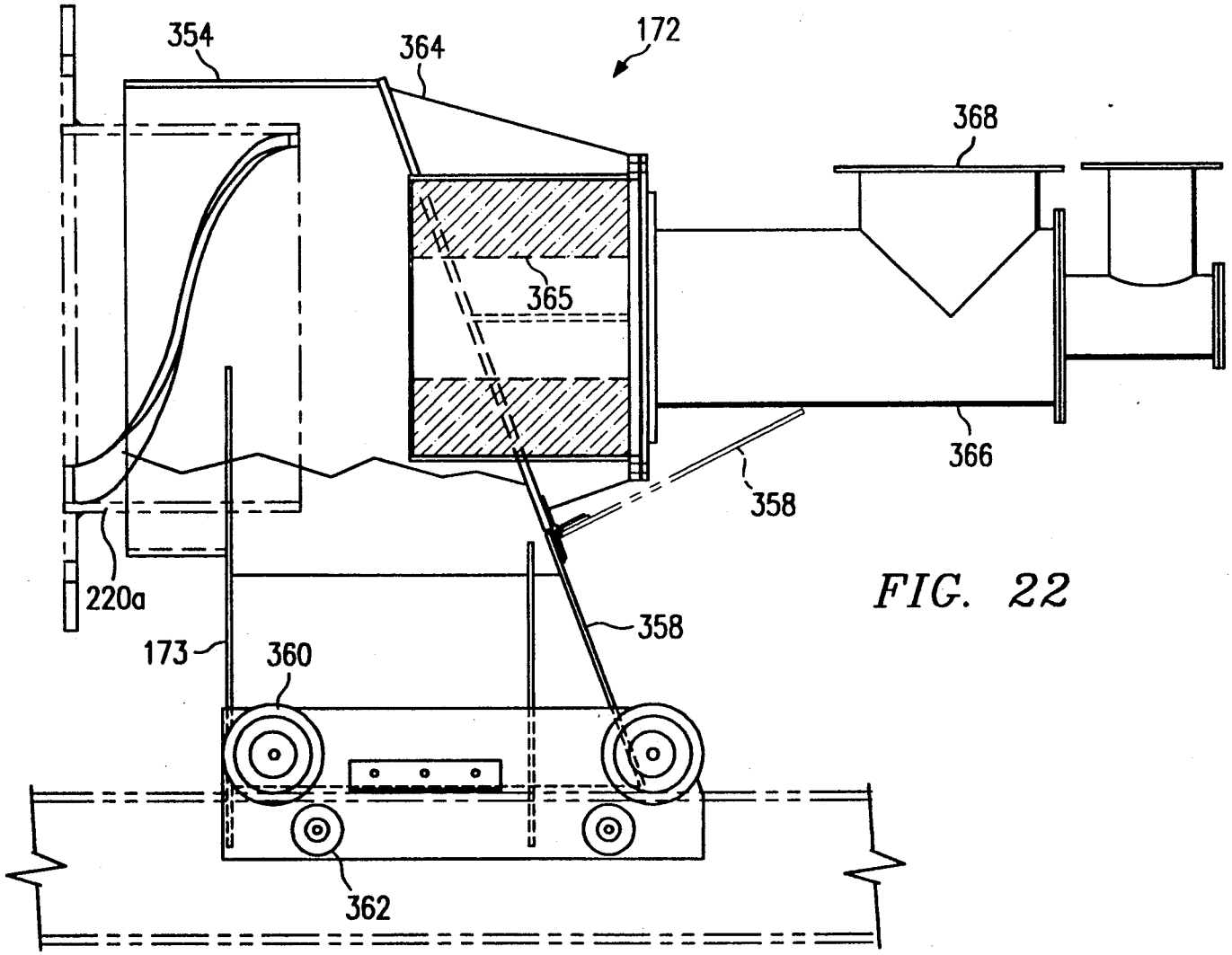
FIG. 22 is a side view of the discharge end plate at the kiln ingress.

FIG. 22 illustrates the discharge end assembly 172 which fits over discharge plate 220*a* attached to section 210 of the kiln 120. End assembly 172 is comprised of a housing 364 with an input pipe 366 and a drop chute 173. Combustion air enters pipe 366 through opening 368 and passes into kiln 120. Burner tile 365 insulates housing 364 from the high temperature of the combustion air. Waste exits kiln 120 and falls through retractable door 358 and onto conveyor 171 (not shown). Discharge end assembly 172 is mounted on the furnace frame assembly 218 with rollers 360 that allows the discharge end assembly 172 to be rolled back from the kiln 120. Additional wheels 362 fit under the flange of furnace frame assembly 218 to keep the housing from tipping.

Figure 23:
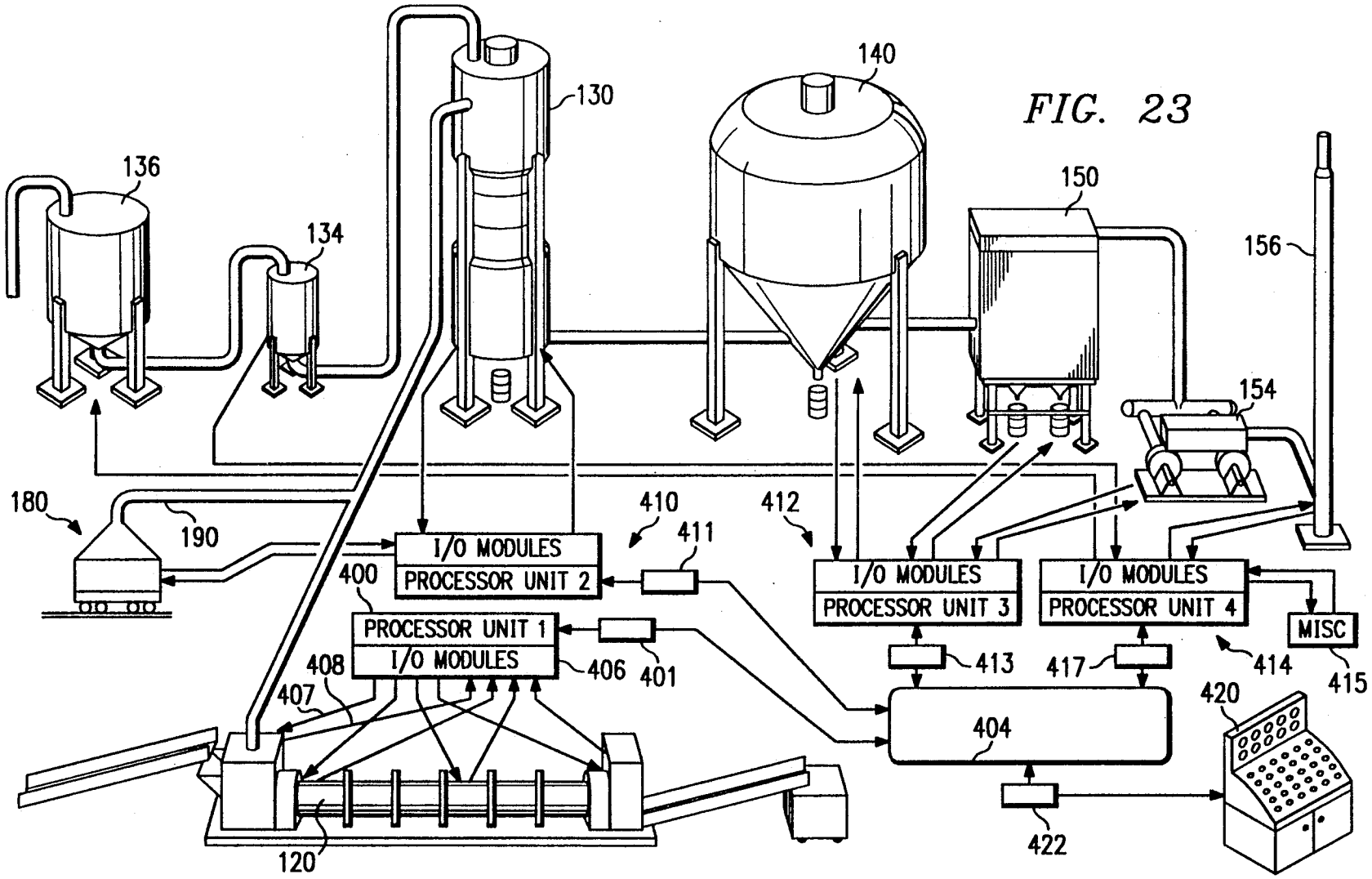
FIG. 23 schematically illustrates the central system for monitoring stack emissions and explosive waste feed rate.

FIG. 23 illustrates the basic architecture for controlling the various subsystems of incinerator 100. The control system includes a number of program-controlled processors, one shown as reference numeral 400, connected by respective optical/electrical interfaces 401 to an optical data highway loop 404. In practice, there are a pair of optical data loops 404, each connected by a separate interface 401 to the processor unit 400. The duplicated data loop 404 and associated interfaces 401 are for purposes of improving the reliability of the control system.

All parametric sensors of each incinerator subsystem are connected to an associated processor by way of an I/O module, such as shown by reference numeral 406. For example, the rotary kiln 120 includes a number of sensor and transducer circuits (not shown) connected by respective analog control lines 407 and 408 to the I/O module 406. Line 407 is a 4–20 ma analog line for controlling an actuator associated with the kiln 120. The actuator may be a motor, the speed of which is controlled by the magnitude of current transmitted on line 407 by the I/O module 406. The kiln 120 has a number of sensors, such as a speed sensor (not shown) which senses the speed of the motor, converts the speed indication into a 4–20 ma signal for transmission to the I/O module 406. The I/O module 406 is connected by many other "to and from" analog transmission lines for serving and controlling many other parameters of the rotary kiln 120. Because the I/O module 406 can accommodate only a specified number of ports to provide the requisite control over the subsystem, a number of similar processors and associated I/O modules are shown so that control over the entire system can be maintained.

As shown in FIG. 23, a second processor unit 410 is connected with numerous bidirectional analog lines to both the car bottom furnace 180 and the secondary combustor 130. The second processor unit 410 is similarly connected to the optical data loop 404 by interface 411. A third processor unit 412 is connected by analog control lines for sensing and controlling the operation of the wet scrubber equipment 140, the baghouse equipment 150 and the dual draft fans 154. Again, the third processing unit 142 is coupled to the optical data loop 404 by interface 413. In the preferred form of the invention, a fourth processor unit 414 is connected with bidirectional analog transmission lines for controlling and sensing the operation of the stack 156 and the liquid waste equipment 134 and 136. The I/O module associated with the processing unit 414 has sufficient ports to control miscellaneous sensors and actuators, as shown by reference numeral 416. The fourth processing unit is coupled to the optical data loop 404 by an interface 417.

Each optical/electrical interface comprises a bidirectional data transfer interface so that data can be coupled, via the data loop 404, from the processor unit 400 to any other processor unit, or other unit connected to the loop 404. In the preferred embodiment of the invention, the processor units 400, the optical/electrical interfaces 401 and the optical data loop 404 are commercially available from Leeds & Northrup, as the MAXI data highway system. When connected together as shown, the processors can communicate with each other so that overall system control can be maintained. Further, each processing unit is microprocessor based and programmed with a standard library of control and logic algorithms for performing continuous processor and batch control.

Manual control and monitoring of the incineration system can be carried out from a remote location by utilizing an operator console 420. The console 420 is connected by one or more optical/electrical interfaces 422 to the optical data loop 404. The operator console 420 provides the primary means of operating and configuring the incinerator system 100. The actual measurement and control of the subsystems is carried out collectively by the processor units, each of which receives basic commands from the operator console 420. The console 420 can be considered as a "window" to the control actions performed by the remote processing units via the optical data loop 404.

The overall functions carried out for controlling the incinerator system 100 includes a start-up procedure. Prior to initiation of the start-up procedure, precommissioning work is performed to insure that the equipment, piping and instrumentation have been checked for proper mechanical condition, and the refractory has been cured. Further, all valves are checked so that they are reset in the correct position and the control logic of the processing units has been appropriately reset or cleared. All utilities systems such as electric power, instrument air, and soda ash solution are also checked for operational status. The waste disposal system is checked to make sure that it has been cleared for additional loads, and the kind of waste control room to be incinerated has been determined and the computer has been programmed accordingly.

In particular, when it is desired to start the system 100 for use with the rotary kiln 120, the baghouse 150 is isolated and the baghouse bypass is opened to insure solids on the bags do not absorb moisture from the cold air/flue gas. Next, the draft fans 154 are activated, and then the kiln discharge system, the rotary kiln rotation and the waste feed system are activated. The waste feed system is activated, depending on the selected type of waste feed. The rotary kiln burner and primary combustor air blower are then activated to establish an exhaust temperature of about 300°-350° F. The secondary combustor burner and the secondary combustor air blower are then activated to establish an exhaust temperature of about 400°-500° F. Next, the spray dryer water flow subsystem is activated so that automatic control of the water flow is established to achieve an exhaust of about 350° F. The bypass of the baghouse 150 is then closed and the baghouse is lined up for operation. The rotary kiln temperature is then increased to provide the appropriate temperature, such as 2100°-2200° F., depending upon the type of matter to be incinerated. Valves are activated so that the soda ash solution in the spray dryer 140 becomes operative to coat the bags in the baghouse 150 appropriately. Lastly, the waste is introduced into the rotary kiln 120, and overall temperatures and pressure profiles are maintained to decontaminate the waste with minimal pollutants being discharged into the atmosphere.

In the event the system 100 is to be operated in conjunction with the car bottom furnace 180, the following sequence is carried out. The baghouse 150 is isolated, and the bypass is opened to insure that solids on the bags do not absorb moisture from the cold air/flue gas. The draft fans 154 are activated, but operated to produce a reduced flow of only about 50%. The secondary combustor burner and the secondary combustor air blower are activated to establish an exhaust temperature of about 400°-500° F. The water flow in the spray dryer 140 is activated to automatically achieve a water flow to produce an exhaust temperature of about 350° F. Next, the baghouse bypass is closed and the baghouse is lined up. The firing temperature of the burner in the car bottom furnace 180 is activated to produce an exhaust temperature at about 2100°-2200° F. The soda ash solution is adjusted in the spray dryer 140 to produce an appropriate flow to coat the bags in the baghouse 150. A blower in the car bottom furnace 180 is activated to commence batch incineration of the contaminants loaded onto the car bottom.

During start-up of the incinerator system 100 with either the rotary kiln 120 or the car bottom furnace 180, the fuel feed to the various burners of the system can be controlled to provide a controlled increase in temperature. In other words, rather than an operator manually adjusting fuel feed to the burners over a period of time to reduce thermal stress to the system, the appropriate processing units can be programmed to automatically increase the burner temperatures in either a steady ramped manner, or a stepped manner so that a substantially constant temperature gradient is maintained, until full operational status is achieved. The burners in the rotary kiln 120, the car bottom furnace 180 and the secondary combustor 130 can be controlled in the manner noted. The same can be achieved in shutdown of the system, wherein the fuel feed to the burners is reduced systematically to again reduce thermal stress and shock to the system.

In a typical shutdown sequence of the incineration system 100, the conveyor input to the rotary kiln 120 is stopped so that waste materials are no longer introduced into the kiln. The temperature of the kiln 120 is maintained until the wastes therein are decontaminated, and thereafter the burner temperature in the secondary combustor 130 is reduced, and the air blower is deactivated so that the firing temperature is correspondingly reduced to about 400° F. The rotary kiln burner is reduced and the primary combustion air blower is deactivated to further reduce the firing temperature to about 300°-350° F. Then, the soda ash feed to the spray dryer wash 140 is reduced, and the bypass mechanism for the baghouse 150 is deactivated. This brings a maximum baghouse temperature to about 400° F. Water flow to the spray dryer 140 is reduced and the burners associated with the kiln 120 are reduced gradually to reduce the temperature, as well as avoid excessive thermal stress and shock to the equipment. The primary combustion air blower as well as the secondary combustion air blower are deactivated so as also to reduce excessive thermal stress and shock. Once the rotary kiln 120 has been sufficiently cooled, the rotation thereof is halted and the kiln discharge system is deactivated. Lastly, the dual draft fans 154 are shutdown to avoid excessive thermal stress and shock to the system.

In a shutdown sequence involving the car bottom furnace 180, such furnace and the associated blower are first deactivated. The burner in the secondary combustor 130 is reduced, as is the air blower to reduce the firing temperature to about 400° F. The soda ash feed to the spray dryer 140 is deactivated. In like manner, the bypass to the baghouse 150 is deactivated to achieve a maximum baghouse temperature of about 400° F. Water flow to the spray dryer 140 is then terminated. The burner and the air blower associated with the secondary combustor 130 are then shutdown to a void excessive thermal stress and shock. In like manner, the dual blowers 154 are deactivated, again to avoid excessive thermal stress and shock to the system.

In a preferred embodiment, all of the measuring devices (e.g., flowmeters and thermocouples) mentioned are located on the kiln, in its outlet duct, or its fuel and waste feed systems. All of the indicating devices (e.g., digital readouts and computer monitor) and controllers are located, except where otherwise noted, on the control console 420 in the control room. The data acquisition and control computer, located in the control room, is used to continuously acquire and store selected critical measurements. These measurements are continuously displayed on the computer monitor and are printed at 15-minute intervals. This computer may be programmed, in the future, to control selected operating functions, including automatic waste feed shut off functions based on the information it acquires.

Kiln outlet temperature is measured by redundant thermocouples located in the outlet duct of the rotary kiln. One of these thermocouples is connected to a digital readout on the control console 450 and to a low-temperature switch which activates the automatic waste feed shut-off circuit to shut off all waste feed to the kiln when kiln outlet temperatures fall below a preselected level (typically 400° F.). The other is connected to the data acquisition and control computer which displays readings on the computer monitor.

Negative pressure in the kiln is measured by a pressure transducer on the outlet duct of the kiln 120. This transducer transmits to a digital readout indicator on the control panel, the data acquisition and control computer which displays readings on the computer monitor and to a low pressure switch that activates the waste feed shut-off circuit to shut off all waste feed to the kiln when a loss of negative pressure occurs in the kiln. Kiln negative pressure also is redundantly measured by a pressure gage located on the outlet duct of the kiln.

The kiln flame and conditions inside of the kiln 120 are monitored by a UV sensor which is connected to the control console 450. The UV flame detector monitors the kiln flame and signals the kiln flame supervisor to shut-off all waste feed to the kiln when there is a loss of flame.

Natural gas to the kiln burner is measured with a flow meter which sends signals to the data acquisition and control computer which displays readings on the computer monitor, a digital readout which provides both an instantaneous and totalized reading, and a controller which controls a pneumatic or electric modulating valve on the fuel feed line to the burner. The controller can be operated manually or automatically (using preprogrammed setpoints) to control fuel feed rate to the burner. The modulating valve is set to fail closed when there is a loss of signal from the controller.

The fuel feed line to the kiln burner is equipped with two redundant electrically operated shut off valves. These valves are controlled by the flame supervisor serving the kiln to permit the feeding of fuel to the burner when a flame exists or shut off fuel feed to the burner when certain upset conditions occur. The fuel feed line also is equipped with a low-pressure switch which is connected to a low pressure alarm and to the flame supervisor to enable the flame supervisor to prohibit the feed of fuel to the burner or to shut off fuel feed to the burner when there is inadequate fuel feed pressure. Finally, the fuel feed line is equipped with a number of pressure indicators (with local readouts), and manually operated shut off valves.

Combustion air flow to the kiln burner is measured by a pitot tube primary element in the combustion air supply duct. The flow transmitter for this device sends a signal to the data acquisition and control computer which displays readings on the computer monitor and to a controller which provides a digital readout and controls a pneumatically-activated modulating valve on the combustion air supply line. The controller can be operated manually or automatically to control combustion air flow rate to the kiln burner.

The motor of the primary combustion air blower is wired to signal the flame supervisor when it is not operating. When such a signal is received during ignition of the burner, the flame supervisor prevents the ignition sequence. When such a signal is received during operation, the flame supervisor shuts off fuel feed to the burner and signals the waste feed cut-off circuit to shut off all waste feed to the kiln.

Solid waste feed is measured by the belt scale before being conveyed to the charge conveyor which discharges to the elevated feed chute.

Secondary combustor gas outlet temperature is measured by redundant thermocouples located in the duct connecting the secondary combustor to the spray dryer. One of these thermocouples is connected to a digital readout on the control panel and to a low-temperature switch which activates the waste feed cut-off circuit to shut off all waste feeds to both units when secondary combustor outlet temperature falls below a predetermined temperature. The other thermocouple is connected to the data acquisition and control computer which displays readings on the computer monitor.

Secondary combustor outlet pressure is measured by a pressure transducer on the outlet duct that transmits to a digital readout indicator on the control panel and to the data acquisition and control computer which displays readings on the computer monitor.

The secondary combustor flame and conditions inside of the secondary combustor are monitored by a UV sensor which is connected to the control panel. The UV flame detector monitors the secondary combustor flame and signals the flame supervisor when there is a loss of flame. Fuel and combustion air feeds to the burner of the secondary combustor are measured and controlled in the same manner as described for the rotary kiln. Gas residence time in the secondary combustor is continuously computed by the data acquisition and control computer from measurements of the feed rates of wastes, fuel and combustion air to the kiln and the secondary combustor and assumed values for infiltration air and contributions from solid waste feeds. The calculated residence time is displayed on the computer monitor and is printed every 15 minutes.

Although preferred embodiments of the invention have been described in the foregoing Detailed Description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications, and substitutions of parts and elements as fall within the spirit and scope of the invention.

We claim:

1. An incinerator for use in destroying hazardous waste, said destruction producing exhaust gases and destroyed waste, comprising:

(a) a kiln with a waste entrance, a waste exit, an air entrance and an air exit;
(b) means to heat said kiln;
(c) means to feed waste into the waste entrance;
(d) means to withdraw destroyed waste from the waste exit;
(e) pollution control means in communication with said air exit; and
(f) means to pull combustion air through the kiln and the pollution control means; and
(g) primary, secondary, and tertiary means to contain fugitive exhaust gases from the kiln.

2. The incinerator of claim 1 wherein said kiln comprises:

(a) a cylindrical structure with an ingress and egress with a helical flight therebetween;
(b) a feed assembly dynamically sealed over the ingress of the cylindrical structure; and
(c) a discharge assembly dynamically sealed over the egress of the cylindrical structure.

3. The incinerator of claim 1 wherein said kiln revolves around its longitudinal axis.

4. The incinerator of claim 1 wherein said means to feed waste comprises a positive feed system.

5. The incinerator of claim 1 wherein said means to feed waste comprises a continuous feed system.

6. The incinerator of claim 1 wherein said means to withdraw destroyed waste comprises a discharge conveyor system.

7. The incinerator of claim 1 wherein said means to pull combustion air comprises at least one induced draft fan in communication with such kiln air exit.

8. The incinerator of claim 1 wherein said means to heat said kiln comprises a burner assembly in communication with said kiln air entrance.

9. The incinerator of claim 1 wherein said pollution control means is located in series along a combustion air path and comprises:

(a) a secondary combustor adjacent said kiln;
(b) a spray dryer adjacent said secondary combustor;
(c) a baghouse adjacent said spray dryer; and
(d) a stack.

10. An incinerator for use in destroying hazardous waste, said destruction producing exhaust gases and destroyed waste, comprising:

(a) a rotary kiln with a helical flight therein, said helical flight defining a waste path and a combustion air path, said rotary kiln located within a containment building with at least one blast wall;
(b) a feed assembly removably placed over the ingress to the waste path;
(c) a discharge assembly removably placed over the egress to the waste path;
(d) means to feed waste into said feed assembly attached to said feed assembly;
(e) means to withdraw destroyed wastes from said discharge assembly attached to said discharge assembly;
(f) means to pull combustion air through the combustion air path in the rotary kiln thereby entraining exhaust gases, said means to pull combustion air further pulling the combustion air and entrained exhaust gases through pollution control means;
(g) burner means attached to said rotary kiln to heat said combustion air;
(h) means to contain fugitive exhaust gases and reintroduce said fugitive exhaust within said combustion air path;
(i) means to control the rate at which waste is fed to the feed assembly; and
(j) pollution control means.

11. The incinerator of claim 10 wherein said rotary kiln comprises:

(a) a generally cylindrical structure mounted on three pair of trunion assemblies spaced along the length of the cylindrical structure;
(b) a variable speed drive motor connected to at least two pair of trunion assemblies; and
(c) a charge plate removably attached to the end of the cylindrical structure which defines the ingress of the waste path.

12. The incinerator of claim 10 wherein said feed assembly comprises:

(a) a frame defining an enclosed structure;
(b) a horizontal trough defining a feed path within said structure leading from a first orifice in said structure to a third orifice in said structure;
(c) an angled trough defining a feed path within said structure leading from a second orifice above said first orifice to the third orifice;
(d) an exhaust port in said structure;
(e) first means to removably block said first orifice;
(f) second means to removably block said second orifice; and
(g) third means to removably block the feed path between said horizontal trough and said third orifice.

13. The incinerator of claim 12 wherein said feed assembly further comprises a feed chute attached to said frame such that the chute narrows toward the second orifice.

14. The incinerator of claim 12 wherein said first and second means to removably block comprises:

(a) a first and second door slidably mounted to said frame such that the sliding path of said doors respectively allows coverage of the first and second orifices;

(b) a pneumatic actuator attached between said frame and said first door; and (c) a pneumatic actuator attached between said frame and said second door.

15. The incinerator of claim 12 wherein said third means to removably block comprises:

(a) a third door slidably mounted beneath said angled trough such that the sliding path of said third door allows coverage of the distal end of the horizontal trough; and (b) a pneumatic actuator attached between said chute and said third door.

16. The incinerator of claim 12 wherein said third orifice is dimensioned to compliment the ingress to the waste path within the rotary kiln.

17. The incinerator of claim 10 wherein said discharge assembly comprises:

(a) a frame defining a generally cylindrical structure with a combustion air ingress, a combustion air egress, and destroyed waste egress;

(b) a door pivotally attached to said frame such that said door removably covers said destroyed waste egress; and (c) means to position said structure adjacent the egress of the waste path of the rotary kiln.

18. The incinerator of claim 10 wherein said discharge assembly is further comprised of a frame with a combustion air egress dimensioned to compliment the waste path egress of said rotary kiln.

19. The incinerator of claim 10 wherein said means to feed waste is a continuous feed system.

20. The incinerator of claim 19 wherein said continuous feed system further comprises:

(a) a loading conveyor on which hazardous waste is placed;

(b) a primary waste feed conveyor which is positioned to accept waste conveyed to it by the loading conveyor; and (c) a kiln charge conveyor which is positioned to accept waste conveyed to it by the primary waste feed conveyor.

21. The incinerator of claim 20 wherein said loading conveyor is equipped with an integrated belt scale.

22. The incinerator of claim 20 wherein said loading conveyor is substantially horizontal.

23. The incinerator of claim 20 wherein said primary waste feed conveyor is angled such that its distal end is elevated above its proximal end.

24. The incinerator of claim 20 wherein said primary waste feed conveyor transports waste through an opening in the blast wall.

25. The incinerator of claim 20 wherein said kiln charge conveyor is substantially horizontal.

26. The incinerator of claim 19 wherein said continuous feed system is comprised of three conveyors which are neither horizontally nor vertically in-line with each other.

27. The incinerator of claim 10 wherein said means to feed waste is a positive feed system.

28. The incinerator of claim 27 wherein said positive feed system comprises:

(a) a weighing conveyor for accepting the hazardous waste packaged in a consumable box;

(b) a pacing conveyor positioned to accept said box from said weighing conveyor;

(c) an input conveyor positioned to accept said box from said pacing conveyor;

(d) a transfer conveyor positioned to accept said box from said input conveyor to transport said box to a position in front of said feed assembly; and (e) a feed ram positioned to push said box into said feed assembly.

29. The incinerator of claim 28 wherein said positive feed system further comprises a safety enclosure positioned to accept a box from said transfer conveyor.

30. The incinerator of claim 28 wherein said input conveyor transports the box through an opening in the blast wall.

31. The incinerator of claim 28 wherein said transfer conveyor is substantially perpendicular to said input conveyor.

32. The incinerator of claim 10 wherein said means to withdraw destroyed waste from said discharge assembly comprises:

(a) a discharge conveyor positioned to accept destroyed waste from said discharge assembly;

(b) a shaker grate positioned to accept destroyed waste from said discharge conveyor, said shaker grate capable of separating the waste into an ash component and a scrap metal component, each component deposited on separate conveyor means;

(c) ash collection means positioned to accept ash component from the ash component conveyor means; and (d) scrap metal collection means positioned to accept scrap metal component from the scrap metal conveyor means.

33. The incinerator of claim 10 wherein said means to pull combustion air comprises at least one induction draft fan.

34. The incinerator of claim 10 wherein said means to pull combustion air comprises two induction draft fans each capable of pulling the total required combustion air.

35. The incinerator of claim 10 wherein said means to contain exhaust gases comprises:

(a) a first shroud over the interface of the kiln and the feed assembly;

(b) a second shroud over the interface of the kiln and the discharge assembly; and (c) a primary combustion air blower connected to said first and second shrouds by duct means, said blower drawing gases collected in said shrouds and circulating said gases into said rotary kiln.

36. The incinerator of claim 35 wherein either said first or second shroud comprises:

(a) an upper semi-circular structure;

(b) a lower semi-circular structure;

(c) cap means to connect said upper and lower semi-circular structures;

(d) a tab plate extending from the inner circumferential surface of each semi-circular structure; and (e) an exhaust port extending from said upper semi-circular structure.

37. The incinerator of claim 10 wherein said means to contain exhaust gases further comprises a secondary combustion blower attached to said containment building by duct means to draw any exhaust gases from within said containment building.

38. The incinerator of claim 10 wherein said means to control feed rate comprises:

(a) at least one program-controlled processor unit;
(b) an optical data highway loop; and
(c) an optical/electrical interface connecting said at least one program-controlled processor unit to said data highway loop.

39. The incinerator of claim 10 wherein said pollution control means treats said combustion air with exhaust gases entrained therein by allowing said gases to pass through a series of elements, each element connected by suitable duct work, said pollution control means comprising:

(a) a secondary combustor;
(b) a spray dryer to cool and neutralize said flue gas;
(c) a baghouse to remove particulate matter entrained in said flue gas; and
(d) a stack to disperse said flue gas into the atmosphere.

40. An incinerator for use in destroying hazardous waste, said destruction producing exhaust gases and destroyed waste, comprising:

(a) a rotary kiln with a helical flight cast therein, said helical flight defining a waste path with an ingress and an egress and a combustion air path with an air ingress and an air egress for travel of combustion air through the rotary kiln, said rotary kiln located within a containment building;
(b) means to heat said combustion air prior to its entrance into said air ingress of said rotary kiln;
(c) a feed assembly removably placed over the ingress to the waste path;
(d) a discharge assembly removably placed over the egress of the waste path;
(e) a continuous feed system attached to said feed assembly;
(f) a positive feed system attached to said feed assembly;
(g) a waste discharge system attached to said discharge assembly;
(h) a first shroud surrounding the interface between the feed assembly and the ingress to the waste path;
(i) a second shroud surrounding the interface between said discharge assembly and the egress of the waste path;
(j) a primary combustion air blower connected via duct means to both the first and second shrouds;
(k) a secondary combustion blower connected via duct means to said containment building;
(l) a secondary combustor with an ingress and an egress, said ingress connected via duct means to said rotary kiln air egress;
(m) a spray dryer with an ingress and an egress, said ingress connected via duct means to said secondary combustor egress;
(n) a baghouse with an ingress and an egress, said ingress connected via duct means to said spray dryer egress;
(o) a stack with an ingress and an egress, said ingress connected via duct means to said baghouse egress;
(p) a pair of induction fans placed between said baghouse and stack within said duct means between said stack and said baghouse, said induction fans capable of pulling the combustion air through said rotary kiln through said combustion air path; and
(q) means to control the rate at which waste is fed to the rotary kiln in response to exhaust gas emissions from the stack.

41. The incinerator of claim 40 wherein said rotary kiln with a helical flight cast within comprises:

(a) four central retort sections, each removably attached to its adjacent section;
(b) a first end retort sections removably attached to the proximal end of the assembled central retort sections;
(c) a second end retort section removably attached to the distal end of the assembled central retort sections; and
(d) gasket means between the attachment surfaces of each attached pair of retort sections.

42. The incinerator of claim 40 wherein said rotary kiln is mounted on three pair of trunion assemblies evenly spaced along the length of said rotary kiln.

43. The incinerator of claim 42 wherein at least two pair of trunion assemblies are driven by a variable speed drive motor.

44. The incinerator of claim 40 wherein said means to heat said combustion air comprises a natural gas burner.

45. The incinerator of claim 40 wherein said feed assembly comprises:

(a) a frame defining an enclosed structure;
(b) a horizontal trough defining a feed path within said structure leading from a first orifice in said structure to a third orifice in said structure;
(c) an angled trough defining a feed path within said structure leading from a second orifice above said first orifice to the third orifice;
(d) an exhaust port in said structure;
(e) first means to removably block said first orifice;
(f) second means to removably block said second orifice;
(g) third means to removably block the feed path between said horizontal trough and said third orifice;
(h) a pair of removable doors leading to the interior of said structure; and
(i) a feed chute attached to said frame such that the chute narrows toward the second orifice.

46. The incinerator of claim 45 wherein said first and second means to removably block comprises:

(a) a first and second door slidably mounted to said frame such that the sliding path of said doors respectively allows coverage of the first and second orifices;
(b) a pneumatic actuator attached between said frame and said first door; and
(c) a pneumatic actuator attached between said frame and said second door.

47. The incinerator of claim 45 wherein said third means to removably block comprises:

(a) a third door slidably mounted beneath said angled trough such that the sliding path of said third door allows coverage of the distal end of the horizontal trough; and
(b) a pneumatic actuator attached between said chute and said third door.

48. The incinerator of claim 40 wherein said discharge assembly comprises:

(a) a frame defining a generally cylindrical structure with a combustion air ingress, a combustion air egress, and a destroyed waste egress;

(b) a door pivotally attached to said frame such that said door removably covers said destroyed waste egress;
(c) means to position said structure adjacent the egress of the waste path of the rotary kiln; and
(d) burner tile lining an inner portion of said cylindrical structure between said combustion air ingress and said combustion air egress.

49. The incinerator of claim 40 wherein said continuous feed system comprises:
(a) a substantially horizontal loading conveyor on which hazardous waste is placed;
(b) an integrated belt scale attached to said loading conveyor;
(c) a primary waste feed conveyor positioned to accept waste conveyed to it by the loading conveyor, and transporting said waste through an opening in said blast wall; and
(d) a kiln charge conveyor positioned to accept waste conveyed to it by the primary waste feed conveyor, said kiln charge conveyor leading to the feed assembly.

50. The incinerator of claim 40 wherein said continuous feed system is comprised of three conveyors which are neither horizontally nor vertically inclined with each other.

51. The incinerator of claim 40 wherein said positive feed system comprises:
(a) a weighing conveyor for accepting the hazardous waste packaged in a consumable box;
(b) a pacing conveyor positioned to accept said box from said weighing conveyor;
(c) an input conveyor positioned to accept said box from said pacing conveyor;
(d) a transfer conveyor positioned to accept said box from said input conveyor to transport said box to a position in front of said feed assembly;
(e) a feed ram positioned to push said box into said feed assembly;
(f) a safety enclosure positioned to accept a box from said transfer conveyor; and
(g) a retractable feed fence between said safety enclosure and said transfer conveyor.

52. The incinerator of claim 40 wherein said waste discharge system comprises:
(a) a discharge conveyor positioned to accept destroyed waste from said discharge assembly;
(b) a shaker grate positioned to accept destroyed waste from said discharge conveyor, said shaker grate capable of separating the waste into an ash component and a scrap metal component, each component deposited on separate conveyor means;
(c) ash collection means positioned to accept ash component from the ash component conveyor means; and
(d) scrap metal collection means positioned to accept scrap metal component from the scrap metal conveyor means.

53. The incinerator of claim 40 wherein either said first or second shroud comprises:
(a) an upper semi-circular structure;
(b) a lower semi-circular structure;
(c) cap means to connect said upper and lower semi-circular structures;
(d) a tab plate extending from the inner circumferential surface of each semi-circular structure; and
(e) an exhaust port extending from said upper semi-circular structure.

54. The incinerator of claim 40 wherein said primary combustion air blower circulates flue gas collected in the first and second shrouds to the rotary kiln.

55. The incinerator of claim 40 wherein said secondary combustion circulates flue gas collected in said containment building to the secondary combustor.

56. The incinerator of claim 40 wherein said secondary combustor comprises:
(a) a combustion chamber sized to allow at least four seconds of flue gas residence time at a temperature of 2200° F.;
(b) an injector nozzle for burner fuel adjacent said flue gas ingress; and
(c) a ceramic fiber module lining attached to the walls of the combustion chamber.

57. The incinerator of claim 40 wherein said spray dryer comprises:
(a) a mixing chamber;
(b) at least one injection nozzle for said chamber attached to a soda ash solution; and
(c) means to remove precipitate from the mixing chamber.

58. The incinerator of claim 40 wherein said baghouse comprises:
(a) a structure with three internal modules;
(b) at least twenty bags within each module; and
(c) means to remove collected dust from said structure.

59. The incinerator of claim 40 wherein said stack is a vertical cylindrical structure between 180 and 250 feet tall.

60. The incinerator of claim 40 wherein said pair of induction fans are sized to individually pull 13,400 acfm.

61. A rotary kiln for use in a hazardous waste incinerator comprising:
(a) four central retort sections, each removably attached to its adjacent section;
(b) a first end retort sections removably attached to the proximal end of the assembled central retort sections;
(c) a second end retort section removably attached to the distal end of the assembled central retort sections; and
(d) gasket means between the attachment surfaces of each attached pair of retort sections;
(e) a first, second, and third pair of trunion assemblies evenly spaced along the length of said six retort section assembly;
(f) a variable speed drive motor attached to the first pair of trunions; and
(g) a drive shaft connecting said first pair of trunions to the second pair of trunions.

62. A feed assembly for use with a rotary kiln as part of a hazardous waste incinerator, said feed assembly comprising:
(a) a frame defining an enclosed structure;
(b) a horizontal trough defining a feed path within said structure leading from a first orifice in said structure to a third orifice in said structure;
(c) an angled trough defining a feed path within said structure leading from a second orifice above said first orifice to the third orifice;
(d) an exhaust port in said structure;
(e) first means to removably block said first orifice;
(f) second means to removably block said second orifice;

(g) third means to removably block the feed path between said horizontal trough and said third orifice;

(h) a pair of removable doors leading to the interior of said structure; and (i) a feed chute attached to said frame such that the chute narrows toward the second orifice.

63. A discharge assembly for use with a rotary kiln as part of a hazardous waste incinerator, said discharge assembly comprising:

(a) a frame defining a generally cylindrical structure with a combustion air ingress, a combustion air egress, and destroyed waste egress;

(b) a door pivotally attached to said frame such that said door removably covers said destroyed waste egress;

(c) means to position said structure adjacent the egress of the waste path of the rotary kiln; and (d) burner tile lining an inner portion of said cylindrical structure between said air ingress and said air egress.

64. A continuous feed system for use in conveying hazardous waste through a blast wall to a feed assembly associated with a rotary kiln as part of a hazardous waste incinerator, said continuous feed system comprising:

(a) a substantially horizontal loading conveyor on which hazardous waste is placed;

(b) an integrated belt scale attached to said loading conveyor;

(c) a primary waste feed conveyor positioned to accept waste conveyed to it by the loading conveyor, and transporting said waste through an opening in said blast wall; and (d) a kiln charge conveyor positioned to accept waste conveyed to it by the primary waste feed conveyor, said kiln charge conveyor leading to the feed assembly.

65. A positive feed system for use in conveying hazardous waste to a feed assembly associated with a rotary kiln as part of a hazardous waste incinerator, said positive feed system comprising:

(a) a weighing conveyor for accepting the hazardous waste packaged in a consumable box;

(b) a pacing conveyor positioned to accept said box from said weighing conveyor;

(c) an input conveyor positioned to accept said box from said pacing conveyor;

(d) a transfer conveyor positioned to accept said box from said input conveyor to transport said box to a position in front of said feed assembly;

(e) a feed ram positioned to push said box into said feed assembly;

(f) a safety enclosure positioned to accept a box from said transfer conveyor; and (g) a feed retractable fence between said safety enclosure and said transfer conveyor.

66. A discharge handling system for use in conveying destroyed waste from a discharge assembly associated with a rotary kiln and through a blast wall as part of a hazardous waste incinerator, said discharge handling system comprising:

(a) a discharge conveyor extending through an opening in the blast wall and positioned to accept destroyed waste from said discharge assembly;

(b) an enclosure attached to the blast wall and positioned over the part of said discharge conveyor outside of the blast wall so that air can be drawn underneath said enclosure, across said discharge conveyor and through the opening in the blast wall;

(c) a shaker grate outside the blast wall and positioned to accept destroyed waste from said discharge conveyor, said shaker grate capable of separating the waste into an ash component and a scrap metal component, each component deposited on separate conveyor means;

(d) ash collection means positioned to accept ash component from the ash component conveyor means; and (e) scrap metal collection means positioned to accept scrap metal component from the scrap metal conveyor means.

67. An air pollution control system for use in treating a flue gas stream exhausting from a rotary kiln with a combustion air egress, said air pollution control system comprising:

(a) a secondary combustor with an ingress and an egress, said ingress connected via duct means to said rotary kiln combustion air egress;

(b) a spray dryer with an ingress and an egress, said ingress connected via duct means to said secondary combustor egress;

(c) a baghouse with an ingress and an egress, said ingress connected via duct means to said spray dryer egress;

(d) a stack with an ingress and an egress, said ingress connected via duct means to said baghouse egress;

(e) a pair of induction fans placed between said baghouse and stack within the combustion air path defined by said duct means, said induction fans capable of pulling air through said rotary kiln and through said combustion air path; and (f) means to control the rate at which waste is fed to the rotary kiln in response to exhaust gas emissions from the stack.

68. A method of treating exhaust gases containing acidic components created by the combustion of hazardous waste within a hazardous waste incinerator comprising:

a) raising the temperature of said exhaust gases to between 1200° to 2200° F. in a secondary combustor;

b) quenching the exhaust gases with a soda ash solution in a spray dryer;

c) converting the acidic components of the exhaust gas to sodium salts with the soda ash solution in the spray dryer;

d) filtering particulate matter from the exhaust gases in a baghouse; and e) dispersing said exhaust gases into the atmosphere through a stack.

69. The method of treating exhaust gases of claim 68 wherein the said step of raising the temperature of the exhaust gases is accomplished under turbulent conditions.

70. The method of treating exhaust gases of claim 68 wherein the step of raising the temperature of the exhaust gases takes place over a residence time of up to four seconds.

71. The method of treating exhaust gases of claim 68 wherein the step of quenching the exhaust gases comprises:

a) neutralizing the acidic components of said exhaust gases, thereby creating a sodium salt;

b) evaporating the liquid portion of the soda ash solution; and c) precipitating sodium salt created by the neutralizing step.

72. The method of treating exhaust gases of claim 68 wherein the step of filtering particulate matter from the exhaust gases comprises passing the exhaust gases through a series of filter bags.

73. The method of treating exhaust gases of claim 68 wherein the step of dispersing said exhaust gases comprises pulling said gases into the stack with at least one induction fan.

74. A method of containing fugitive emissions from a hazardous waste incinerator during waste incinerator, said incinerator comprising a rotary kiln, the ends of which are covered by shrouds, said kiln and shrouds located within a containment building, comprising:

a) maintaining said rotary kiln under negative pressure;

b) maintaining said shrouds under negative pressure; and c) maintaining said containment building under negative pressure.

75. The method of containing fugitive emissions of claim 74 wherein said step of maintaining said rotary kiln under negative pressure comprises pulling 3500 to 400 cubic feet of air per minute through said rotary kiln.

76. The method of containing fugitive emissions of claim 74 wherein said step of maintaining said shrouds under negative pressure comprises pulling between 900 and 1300 cubic feet of air per minute through each kiln.

77. The method of containing fugitive emissions of claim 74 wherein said step of maintaining said containment building under negative pressure comprises maintaining the interior of said building at −0.1 to −1.0 inch of water column.

78. A method of positively feeding waste into a rotary kiln of a hazardous waste incinerator comprises:

a) placing waste onto a weighing conveyor;

b) transferring said waste from said weighing conveyor to a pacing conveyor;

c) transporting said waste on said pacing conveyor;

d) transferring said waste from said pacing conveyor to an input conveyor;

e) transporting said waste on said input conveyor;

f) transferring said waste from said input conveyor to a transfer conveyor;

g) transporting said waste on said transfer conveyor to a position in front of said rotary kiln; and h) injecting said waste into said rotary kiln with a feed ram.

79. The method of positively feeding waste into a rotary kiln of claim 78 wherein the step of placing waste onto a weighing conveyor comprises;

a) putting an amount of waste into a consumable box;

b) putting said consumable box of waste onto said weighing conveyor;

c) weighing said box with a belt scale attached to said weighing conveyor;

d) comparing said weight with a predetermined value; and e) activating said weighing conveyor to transport said consumable box of waste to said pacing conveyor.

80. The method of positively feeding waste into a rotary kiln of claim 78 wherein the step of transporting said waste from on said pacing conveyor:

a) holding a first box in a ready position with a box holding device; and b) releasing a second box held by the box holding device transported to said input conveyor.

81. The method of positively feeding waste into a rotary kiln of claim 78 wherein said step of transporting said waste on said input conveyor comprises:

a) opening a shield door over an opening in a blast wall surrounding said rotary kiln, said input conveyor passing through said opening;

b) activating said conveyor to transfer the consumable box through the opening in the blast wall; and c) closing said shield door.

82. The method of positively feeding waste into a rotary kiln of claim 78 wherein said step of transporting said waste on said transfer conveyor comprises:

a) activating said transfer conveyor;

b) retracting a feed fence from a position above said transfer conveyor; and c) deactivating said transfer conveyor when the waste on said conveyor is in a position in front of said rotary kiln.

83. The method of positively feeding waste into a rotary kiln of claim 82 wherein said step of transporting said waste on said transfer conveyor further comprises:

d) bypassing step c) when the incinerator is in an upset condition; and e) transporting said waste into a safety enclosure situated adjacent the end of the transfer conveyor.

* * * * *